US006295931B1

(12) United States Patent
Cutler et al.

(10) Patent No.: US 6,295,931 B1
(45) **Date of Patent: *Oct. 2, 2001**

(54) INTEGRATED MAGNETIC FIELD SENSORS FOR FUZES

(75) Inventors: David W. Cutler, Albuquerque, NM (US); Eric S. Boltz, Cincinnati, OH (US); Raymond L. Jarratt, Jr., Los Lunas, NM (US)

(73) Assignee: TPL, Inc., Albuquerque, NM (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/265,991

(22) Filed: Mar. 9, 1999

Related U.S. Application Data

(60) Provisional application No. 60/077,525, filed on Mar. 11, 1998, and provisional application No. 60/092,717, filed on Jul. 14, 1998.

(51) Int. Cl.[7] ..... F42C 11/00; F42C 13/08

(52) U.S. Cl. ..... 102/221; 102/221; 102/264

(58) Field of Search ..... 102/221, 264

(56) References Cited

U.S. PATENT DOCUMENTS

| | | | | |
|---|---|---|---|---|
| 3,599,572 | * | 8/1971 | Brackman | 102/70.2 |
| 3,913,484 | * | 10/1975 | Gardner | 102/70.2 |
| 4,072,108 | * | 2/1978 | Lewis et al. | 102/70.2 |
| 4,470,351 | * | 9/1984 | Farace | 102/232 |
| 4,686,885 | * | 8/1987 | Bai | 89/6.5 |
| 4,955,279 | * | 9/1990 | Nahrwold | 89/6.5 |
| 5,271,327 | * | 12/1993 | Filo et al. | 102/207 |
| 5,271,331 | * | 12/1993 | Miller | 102/427 |
| 5,497,704 | * | 3/1996 | Kurschner et al. | 102/264 |
| 5,665,934 | * | 9/1997 | Tuttle et al. | 102/402 |
| 5,705,766 | * | 1/1998 | Farace et al. | 102/215 |
| 6,054,226 | * | 4/2000 | Takeda et al. | 428/682 |
| 6,151,563 | * | 11/2000 | Marinelli | 702/141 |
| 6,163,021 | * | 12/2000 | Mickelson | 244/3.2 |

* cited by examiner

*Primary Examiner*—Charles T. Jordan
*Assistant Examiner*—Lolit Semunegus
(74) *Attorney, Agent, or Firm*—Jeffrey D. Myers

(57) ABSTRACT

An apparatus and method for electronically controlling ordnance fuzes by sensing magnetic fields proximate the ordnance via a magnetic field sensor. The sensor is preferably a giant magnetoresistance detector. For spinning ordnance, in-flight cumulative range can be calculated by counting turns of the spinning ordnance. Ordnance may be armed a pre-determined time after exit of the ordnance from a weapon firing the ordnance as determined by the magnetic field sensor. The invention is also of a giant magnetoresistance sensor and method for making same and an apparatus for and method of sensing angular velocity for spinning ordnance.

12 Claims, 28 Drawing Sheets

$$x(t) - \int_{t_1}^{t_0} s(t)dt - \int_{t_2}^{t_1} s(t)dt$$

$$= \left[\int_{\infty}^{t_0} s(t)dt - \int_{\infty}^{t_1} s(t)dt\right] - \left[\int_{\infty}^{t_1} s(t)dt - \int_{\infty}^{t_2} s(t)dt\right] \qquad (1)$$

$$= \int_{\infty}^{t_0} s(t)dt - 2\int_{\infty}^{t_1} s(t)dt + \int_{\infty}^{t_2} s(t)dt$$

$$F = q(\vec{E} + \vec{v} \times \vec{B})$$

INTEGRATED MAGNETIC FIELD SENSORS FOR FUZES

CROSS-REFERENCE TO RELATED APPLICATIONS

This application claims the benefit of the filing of U.S. Provisional Patent Application Serial No. 60/077,525, entitled SENSITIVE INTEGRATED MAGNETIC FIELD SENSORS FOR FUZES, filed on Mar. 11, 1998; and of U.S. Provisional Patent Application Serial No. 60/092,717, entitled SENSITIVE INTEGRATED MAGNETIC FIELD SENSORS FOR FUZES, filed on Jul. 14, 1998; and the specifications thereof is incorporated herein by reference.

GOVERNMENT RIGHTS

The U.S. Government has a paid-up license in this invention and the right in limited circumstances to require the patent owner to license others on reasonable terms as provided for by the terms of Contract No. DAAE30-98-C-1023 awarded by the U.S. Department of the Army.

BACKGROUND OF THE INVENTION

1. Field of the Invention (Technical Field)

The present invention relates to ordnance fuzes, particularly to safety and rangefinding apparatus for fuzes, and specifically to a magnetic field sensor for ordnance fuzes.

2. Background Art

Modem military ordinance is becoming increasingly sophisticated in an attempt to upgrade safety handling and targeting accuracy. Improved environmental sensors are needed to address these issues. Safing procedures require at least two independent indicators that the round is safe to be armed. Typically, one of these indicators must be environmental (e.g., an accelerometer) and the second can be a timer. A second, positive indicator of safe separation would materially enhance safing mechanisms. Effective ordinance range is more determined by accuracy than absolute distance to target. If sensors on a round were able to use environmental information to keep track of a round's location, effective ordinance range could be expanded.

Fuze technology was based on mechanical devices for many years, typically with each ordinance type and each branch of military having unique implementations. The advent of the exploding foil initiator (EFI) has been instrumental in allowing the transition of some fuzes from mechanical to electronic format. Recent changes are integrating more sophisticated processing into the electronic fuze as a means to improve handling and launching safety as well as targeting accuracy. The Multi-Option Fuze for Artillery (of MOFA) is an example of the current goals for military-wide standardization. Intelligent, in-barrel programmable fuzes being developed today allow a single fuze to fulfill many types of missions.

SUMMARY OF THE INVENTION (DISCLOSURE OF THE INVENTION)

The present invention is of an apparatus and method for electronically controlling ordnance fuzes, comprising sensing magnetic fields proximate the ordnance via a magnetic field sensor. In the preferred embodiment, sensing is done via a giant magnetoresistance detector. For spinning ordnance, in-flight cumulative range can be calculated, preferably by counting turns of the spinning ordnance. Ordnance may be armed a pre-determined time after exit of the ordnance from a weapon firing the ordnance, which can be done with the magnetic field sensor determining the time of exit of the ordnance from the weapon firing the ordnance.

The present invention is also of a giant magnetoresistance sensor and method for making same comprising: providing a magnetic substrate pinned with NiMn; forming a tunnel barrier on said substrate; and forming a topmost permalloy layer. In the preferred embodiment, the tunnel barrier is formed with thermally oxidized Al, preferably according to the National Institute of Standards Josephson junction process.

The present invention is additionally of an apparatus for and method of sensing angular velocity for spinning ordnance comprising: counting turns of the ordnance via a magnetic field sensor; and computing a time derivative of an inverse sine of an output of the counting step.

A primary object of the present invention is to provide for intelligent control of ordnance fuzes using ultra-sensitive magnetic field sensors.

A primary advantage of the present invention is that it provides for such control in both spinning and non-spinning rounds.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS (BEST MODES FOR CARRYING OUT THE INVENTION)

The invention relates to apparatuses and methods for controlling ordnance fuzes electronically by detecting magnetic fields using ultra-sensitive magnetic field sensors, particularly giant magnetoresistance (GMR) detectors that alter electrical resistance in response to shifting magnetic fields. The invention includes the use of magnetic field change detectors to calculate the in-flight cumulative range of spinning rounds (e.g., certain types of howitzers) as well as to provide a safety apparatus for non-spinning rounds (e.g., mortars). The range calculators evaluate the rotation of the round with respect to the earth's magnetic field, with the number of rotations per second and the velocity of the round being used to calculate the traveled range. In the non-spinning round application, the exit of the round from the gun barrel is detected magnetically, so that the round is not armed until clear of the barrel.

The invention relates to ultra-sensitive, nano-Tesla range, magnetic field sensors that have direct application to the safing and targeting problems or modem military ordnance. The use of magnetic fields to detect a round's exit from the gun barrel provides a second, positive environmental indication of safe separation. The use of the earth's magnetic field to derive revolution counting allows the fuze to estimate the total distance traveled since launch. The technology used in the magnetic field sensors is compatible with integrated circuit manufacturing techniques, which allows the sensor and signal processing circuitry to be inexpensively fabricated on the same device.

An important element of future fuze designs will be rugged, sensitive environmental sensors. The present invention relates to magnetic field sensors based on giant magneto-resistance (GMR) devices. These devices are capable of sensitivities approaching that of superconducting detectors and are more sensitive than coil based or Hall effect sensors. This sensitivity is vital in detecting magnetic fields for fuze application. The invention has good immunity from interference such as magnetizable steel components used in the fuze.

Figure 1A:
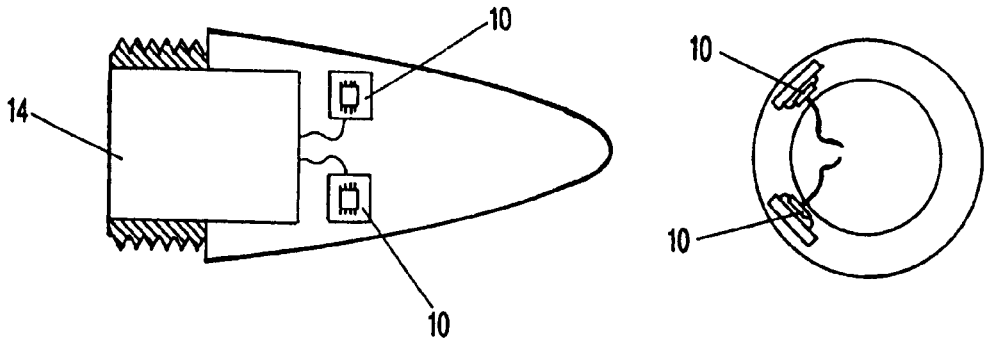
FIGS. 1(*a*) and 1(*b*) illustrate the preferred magnetic field sensors of the invention in the spinning-round and non-spinning-round embodiments.
Figure 1B:
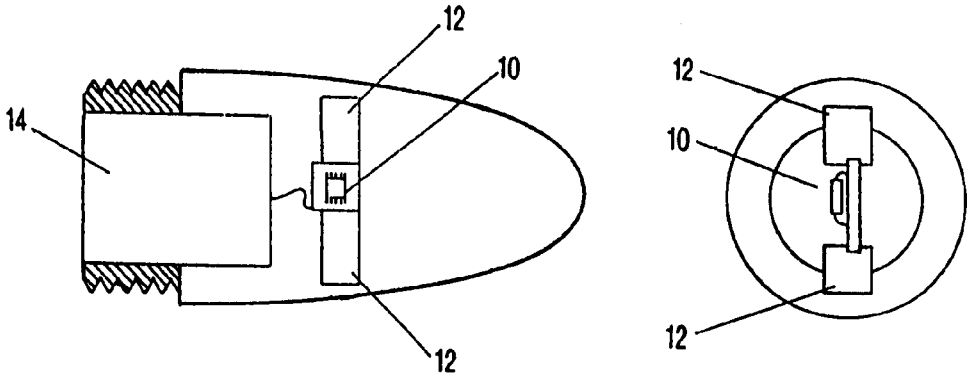

Two magnetic field sensors may be implemented, one for the range application (spinning rounds) and one for the safing application (non-spinning rounds). FIG. 1 illustrates the preferred sensors 10 of the invention in the two applications, with magnet 12 and safe and trigger circuitry 14.

Figure 2:
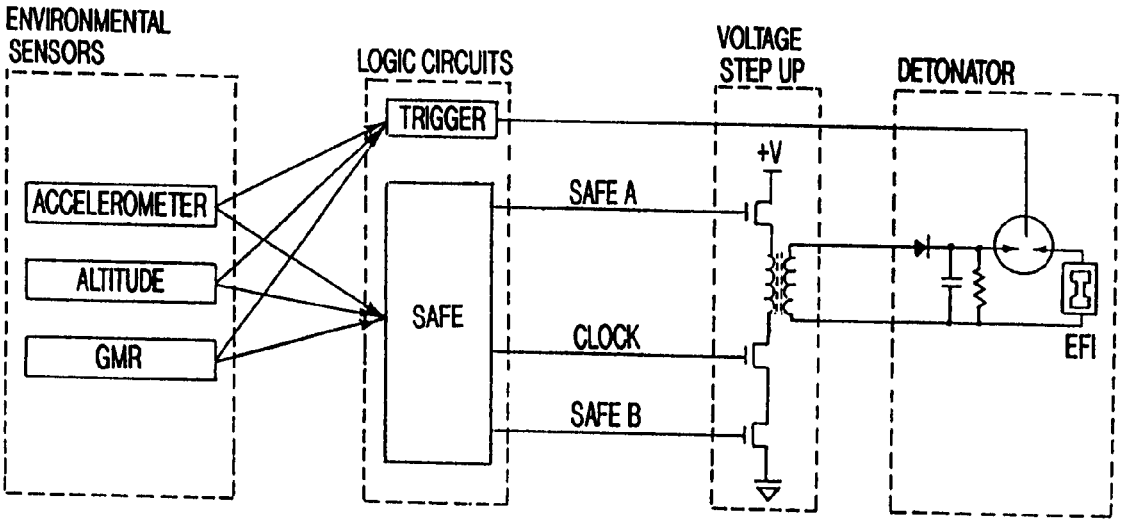
FIG. 2 is a schematic functional diagram of the sensor of the invention in a fuze.
Figure 3A:
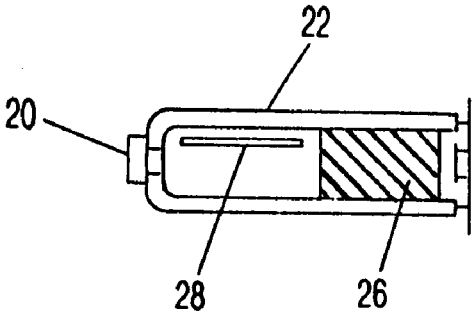
FIGS. 3(*a*)–(*d*) present cut-away side views and top views of the spinning-round ((a) and (b)) and non-spinning-round ((c) and (d)) embodiments.
Figure 3B:
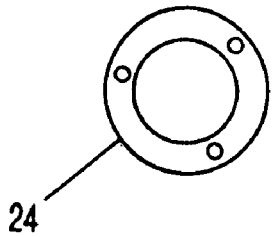
Figure 3C:
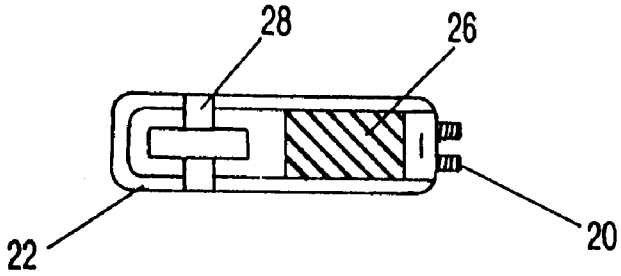
Figure 3D:
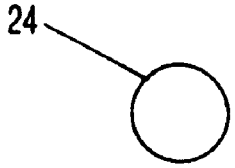

FIG. 2 also shows a diagram of an example fuze of the invention. The independent safe signals must be provided in order to arm the detonator circuit. These safe signals are derived from various environmental sensors. Triggering circuits might also use sensor signals to determine targeting parameters such as range. Modem fuzes have two safety features to prevent improper detonation of the ordinance. First, the detonator cannot be armed indefinitely because its capacitor power source is discharged by a bleeder resistor. Second, the safe circuit forces detonation after launch to eliminate unexploded ordinance problems (UXO).

The service conditions for fuzes are demanding. Examples of these conditions are:

- Shock (or setback) forces during launch are measured in 10,000s of Gs (for example, spinning rounds are qualified at 30,000 Gs, non-spinning rounds at 60,000 G),
- Operating temperatures during launch and flight will vary from −50 to 145° F. and storage temperature will vary from −60° to 160° F.,
- Artillery spin rates vary from 71 revolution/sec (rps) (150 m/sec from a 105 mm gun with 1 revolution/2.1/meters) to as high as 290 rps (900 m/sec muzzle velocity from a 155 mm gun with 1 revolution/3.1 m barrel twist), and Environmental electromagnetic events due to friendly (e.g., high power radar) and non-friendly (e.g., nuclear blast) must not disable or detonate the fuze.

FIG. 3 shows a preferred implementation for the sensor apparatus of the invention, with I/O connectors 20, aluminum case 22, mounting flange 24, electronics 26, and GMR 28.

Recently developed giant magneto resistive (GMR) sensors have shown great promise in a wide variety of applications requiring compact high-sensitivity magnetic field sensors. GMR sensors have potential sensitivities of 1 nT/√Hz. This sensitivity is slightly better than the best flux gate sensor (coil based) and is orders of magnitude better than Hall Effect devices. GMR devices can be made quite small with sensor dimensions down to the micron ($\mu$m) scale. They can also be integrated with on-chip CMOS or bipolar circuitry to make small and very rugged integrated sensor packages. With proper sensor design, GMR sensors can be used over a broad magnetic field range ($10^{-6}$Oe–$10^{3}$Oe) and frequency range (DC-1 GHz). These properties make GMR sensors well suited for military applications such as muzzle exit detectors and sophisticated ordinance fuzes.

For ordinance fuze applications, the performance requirements of the GMR sensor include optimization for 20 mOe–5 Oe fields, low power consumption, high thermal stability, and insensitivity to magnetic shock. A magnetic tunnel junction (MTJ) GMR is the best-suited device for this application. The target device impedance is on the order of 10 kΩ and the operation voltage is 50 mV. This offers a steady state power dissipation of only 20 nW. The field sensitivity, which can be engineered to meet the specific application, is on the order of 10 mV/Oe.

MTJ devices have the best thermal stability of all GMR devices. The device operating resistance is fairly insensitive to temperature over a range of −20° C. to 70° C. (−65° F. to 160° F.). The threshold for irreversible changes to the device operation is also quite high and can be in excess of 300° C. (570° F.). MTJ devices, if properly designed, can tolerate large magnetic fields and should reset to normal operation in less than 1 msec.

The inventive sensor structure consists of a bottom magnetic layer that is pinned with NiMn, which is stable up to 400° C. (750° F.). A tunnel barrier is formed on this substrate using thermally oxidized Al in a manner identical to that of the National Institute of Standards (NIST) Josephson junction process, which is used to fabricate voltage standard chips. Finally a topmost Permalloy layer is deposited as the free or sense layer. With proper design, the free layer completely rotates in a 1 Oe field, resulting in a device magneto resistance change of 10% to 20%.

Before actual device fabrication, prospective device structures and geometries may be modeled using the NIST Micromagnetic Simulator. The device structure characteristics such as magnetic layer thickness, overall device size, and aspect ratios thus can be optimized for this application. Masks may be fabricated using the NIST mask fabrication facility. A variety of device sizes and configurations may be included on the mask set in order to validate modeling results. The tunnel junction structures are then fabricated using a computer controlled magnetic sputtering system. The base layer is patterned with ion milling. Next, the junction area is defined with a precision ion mill and a dielectric layer deposited over the entire wafer. Layer-to-layer interconnects are then open using a reactive ion etch. Finally, a conductive top contact layer is deposited.

Figure 4:
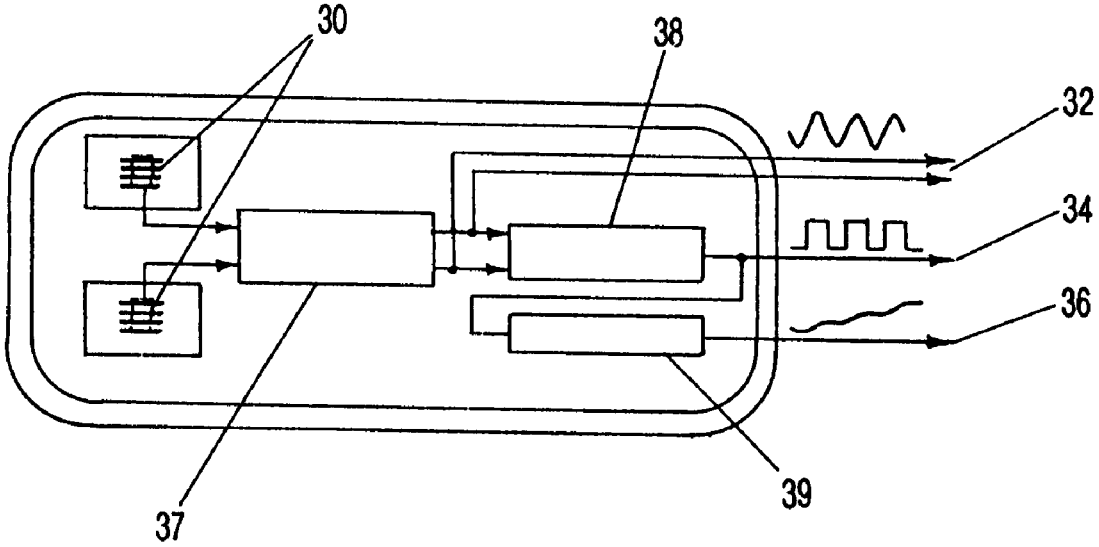
FIG. 4 is a schematic diagram of the spinning-round embodiment.

Spinning Round Circuit Design. Spinning round circuit design involves the integration of GMR devices into a sensitive magnetic field sensor for revolution counting. Signals from the GMR are analyzed using a set of electronics, and status outputs are generated. FIG. 4 shows a preliminary sensor functional diagram, with 90° offset GMR devices 30, scaled detector outputs 32, turns clock 34, range estimate 36, sensor biasing and readout 37, turns detector 38, and integrator 39.

GMR devices are bonded to headers and added to circuitry for biasing and readout. Two GMR devices located at 901 relative offsets are used to sample the ambient magnetic field. The two devices/right angles configuration was selected in order to generate the sine-cosine (or quadrature) signal pair needed for high reliability detection. Field detection could reasonably be performed using only one device, but the preferred configuration results in high reliability detection. All circuitry is compatible with operation from a +3 to +5 VDC power source. Low power componentry is used to lower circuit power consumption. The power consumption goal is 25 mW maximum with a +5 VDC power source.

Sensor biasing and readout are performed using a differential bridge circuit. This approach greatly reduces readout variations due to power supply changes and noise pickup. Drift in readout due to thermal effects is controlled by using bridge element with matching temperature response. The biasing and readout circuitries are designed for a 500 kHz bandwidth.

Figure 5:
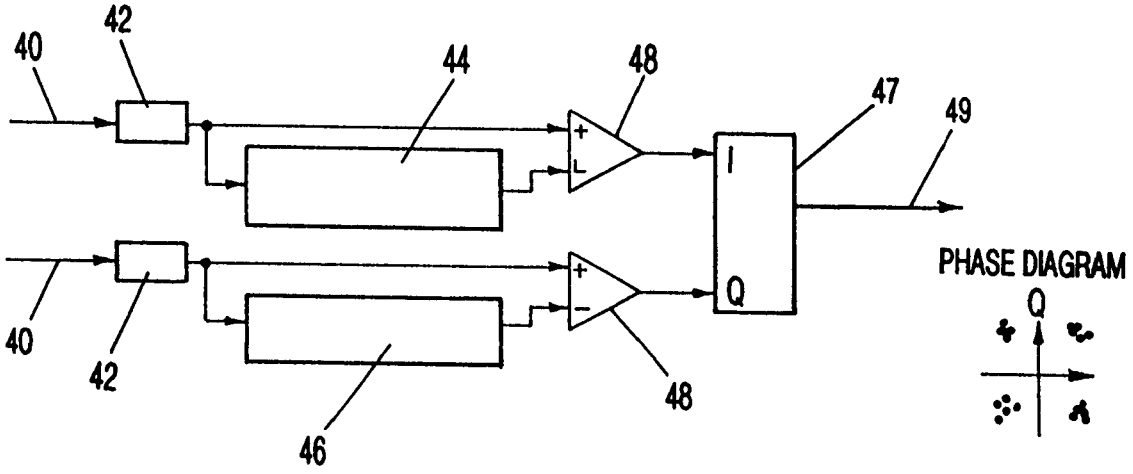
FIG. 5 is a schematic diagram of the turns-detector signal processing of the spinning-round embodiment.
Figure 6:
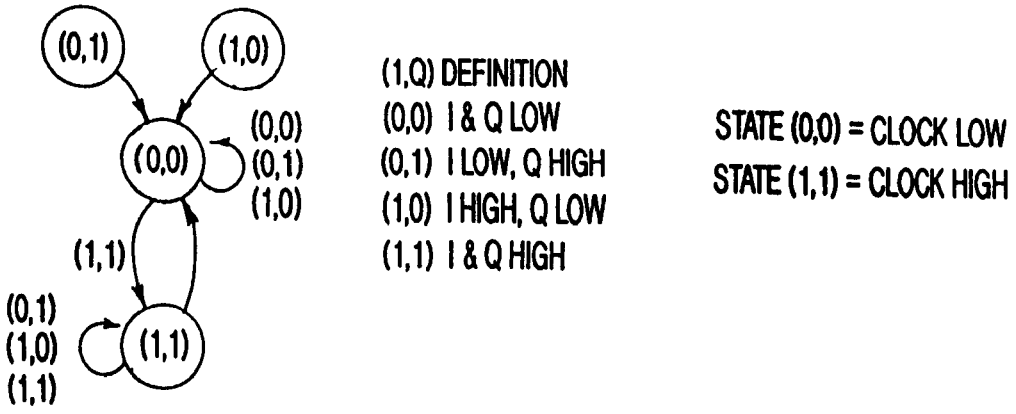
FIG. 6 is a state selector operation diagram for the spinning-round embodiment.

Turns detection uses the quadrature signals produced by the offset sensors 40 to perform the processing diagramed in FIG. 5. The GMR sensors have a very wide bandwidth. Because the signals of interest are in the kHz frequency range, the excess GMR bandwidth can be deleted without losing relevant information. The low pass filters 42 (LPFs) limit the signal bandwidth and associated noise. Filter outputs are used by a set of leaky peak detectors to estimate the in-phase 44 and quadrature signal 46 amplitudes and create a threshold for the signal detector units. Signal detectors 48 convert the analog sensor signals into logic level signals. Hysteresis is used to further reduce the incidence of noise-related errors. Logic signals from the detectors are monitored by the state selector 47 to form the turns dock output 49. If the detector output logic levels are assigned to an ordered pair {I,Q}, where I (or Q)=0 indicates a logic low, and I (or 0)=1 indicates a logic high, then the state selector implements the state sequence shown in FIG. 6.

The earth's magnetic field provides the environmental stimulus for the spinning round sensor. To guarantee detection of this field, the sensor should be tested using fields down to 0.02 Oe. Because sensor output level is a function of its alignment with the earth's magnetic field, the sensor should be tested at 5° compass intervals. As the sensor approaches parallel with the earth's magnetic field, the output level becomes very small. The excellent sensitivity of the GMR sensor provides the best possible performance under these circumstances. Exposure to high magnetic fields of up to 1000 Oe should also be tested. GMR and sensor response to intense fields and recovery time from exposure should be tested during circuit operation.

Sensor output frequency is a function of the ordinance spin rate. To verify correct operation, the sensor may be tested in a spinning test fixture. Spin rates from 1 rps to 300 rps should be tested. Ambient magnetic fields may be varied using moveable magnets to test the sensor response during combined spinning and magnetic field variation.

Sensor response to operating and storage temperature extremes should be tested in a three stage process: (1) the sensors are tested in ambient conditions to establish baseline operation; (2) the sensors are divided into lots and lots placed in −60°, ambient, or 160° F. storage for 48 hours; and (3) the sensors are cycled through temperatures from −50° to 145° F. while operating and their stability recorded.

GMR devices have an inherently wide bandwidth. The GMR device biasing and readout circuitry is designed to support output signals over the frequency band from DC-500 kHz. GMR device and electronics noise (self noise) may be predicted during sensor design and be measured during testing. Most forms of noise are related to bandwidth and the self noise may be measured before and after band limiting operations performed during sensor readout processing.

A GMR/MR based angular velocity sensor is provided by the invention based on the turns counter. Let the turns counter output be f(t). This means that f(ϕ) has the form f(t)=sin(ϕ), so that $\phi=\sin^{-1}(f(\Omega))=\sin^{-1}(f(t))$. Angular velocity is defined as:

$$w = \frac{d\varphi}{dt} = \frac{d}{dt}\{\sin^{-1}(f(t))\}.$$

Therefore, a time derivative of an inverse sine of the output of the turns counter of the invention will provide a measure of the angular velocity.

Figure 7:
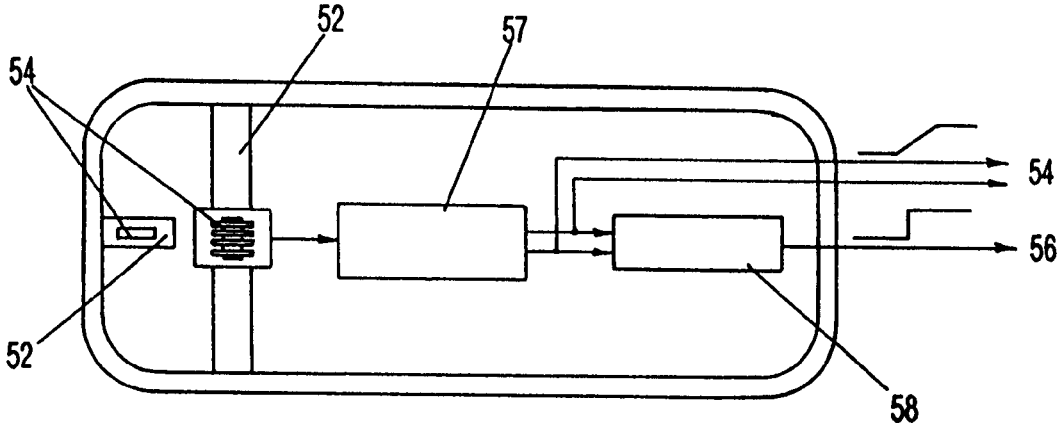
FIG. 7 is a schematic diagram of the non-spinning-round embodiment.

Non-spinning Round Circuit Design. Because magnetic fields exist in the gun barrel, it is possible to use the earth's magnetic field sensors to detect gun barrel exit. Non-spinning round circuit design involves the integration of GMR devices into a sensitive magnetic field sensor for barrel exit detection. Signals from the GMR are analyzed using a set of electronics, and status outputs generated. FIG. 7 shows a preliminary sensor functional diagram, with sensors 50, magnets 52, scaled sensor outputs 54, exit detection output 56, sensor biasing and readout 57, and exit detector 58.

Accurate barrel exit detection is related to the ambient noise level, signal state separation, and sensor bandwidth. If the difference in sensor output between in-barrel and out-of-barrel signals is obscured by ambient noise levels, reliable detection is impossible. If the sensor bandwidth is much smaller than the event bandwidth, both event detection and timing accuracy are degraded.

Ambient noise is fixed by the environment. Barrel magnetism, interfering field generators, and plasma "blow-by" problems during launch are not treatable by the fuze. The invention employs any or all of three techniques to increase detection reliability. Magnets set up fields parallel to the sensors to increase the signal state separation, 90° offset sensors are used to prevent remnant barrel magnetism from swapping both detection fields, and a noise resistant detection technique is used.

The sensor bandwidth is designed to pass the barrel exit signal. Assuming a 0.5 cm wide detector and nominal muzzle velocity of 900 m/sec for a fast round, the sensor signal will change from in-barrel to out-of-barrel states in (0.005/900=) 5.5 μsec. A slow round (150 m/sec) will require (0.005/150=) 33 μsec. In order to pass the first three harmonics of the fast state change, a bandwidth of 5 * 182 kHz (1/5.5 μsec) or 910 kHz is be required.

Figure 8:
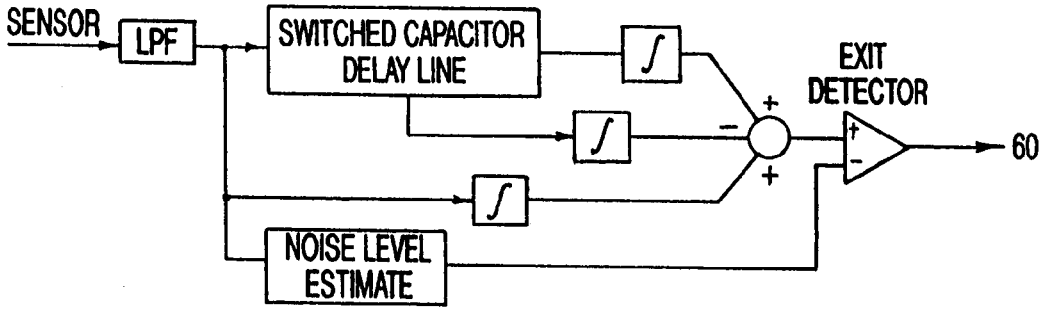
FIG. 8 is a schematic diagram of the turns-detector signal processing of the spinning-round embodiment.

Referring to FIG. 8, the barrel exit 60 is based on robust signal detection techniques described in Equation 1. An optimal indicator, x(t), for a step function (e.g., in-barrel>out-of-barrel condition) embedded in white noise is given by the average sensor output, s(t) from $t_0$ to $t_1$ minus the average sensor output from $t_1$ to $t_2$, where $t_0$ is the present time and $t_1$,$t_2$ are delay times determined by the speed of the round and detector size. The indicator is converted into barrel exit signal 60 by comparing the indicator to an estimate of the noise level. When the indicator rises beyond the noise level, the barrel exit signal is generated.

The circuit required to perform this process consists of three integrators and a switch capacitor analog delay line, all of which are compatible with integrated circuit implementation.

Magnetic fields in the gun barrel provide the environmental stimulus for the non-spinning round "safe" sensor. To guarantee the detection of these fields, the sensor should be tested using fields down to 0.2 Oe. The excellent sensitivity of the GMR sensor provides the best possible performance under these circumstances. Exposure to high magnetic fields of up to 1000 Oe should also be tested. GMR and sensor response to intense fields and recovery time from exposure may be tested during circuit operation.

Sensor response to operating and storage temperature extremes may be tested in three stages: (1) the sensors tested in ambient conditions to establish baseline operation; (2) the sensors are divided into lots and lots placed in −60°, ambient, or 160° F. storage for 48 hours; and (3) the sensors are cycled through temperatures from −50° to 145° F. while operating and their stability are recorded.

GMR devices have an inherently wide bandwidth. The GMR device biasing and readout circuitry is designed to support output signals over the frequency band from DC-1 MHZ. GMR device and electronics noise (self noise) may be predicted during sensor design and measured during testing. Most forms of noise are related to bandwidth, and the self noise is measured before and after band limiting operations performed during sensor readout processing.

Algorithms for sensor data analysis are developed using Matlab™ math modeling software. Analysis algorithms include predictions of sensor self-noise and barrel exit detector performance.

Shock testing should be performed whereby to simulate the high frequency (short duration impulsive) portions of a weapons launch. Because the electronics supporting the GMR sensor are of breadboard quality, only the GMR devices need be shock tested, although preferably shock testing should include both the sensor and supporting electronics.

In order to test spinning round field detection, the spinning round sensor needs to be rotated at a known speed in a known magnetic field. To accomplish this, a DC motor and stand fixture may be used to turn the sensor. The DC motor may be controlled by computer. The motor speed and electronics outputs are recorded by computer. Both signals will be low bandwidth and compatible with computer recording. Optional magnets are placed around the sensor to force a known field orientation. The stand is preferably built of non-ferrous materials, and a low EMI motor used to reduce interfering effects.

Industrial Applicability

The invention is further illustrated by the following non-limiting examples.

EXAMPLE 1

Test of the non-spinning round's field sensor under service conditions is difficult. However, the gun barrel exit detection problem can be equated to a sensitivity and bandwidth problem. First, the sensor must have the sensitivity to clearly separate the "gun barrel present" and "gun barrel not present" signal states; this makes the exit detectable. Second, the sensor must have the bandwidth to produce a sharp transition at the gun barrel exit time; this makes the exit distinguishable from a baseline drift in the sensor due to shock, temperature, etc. To verify the GMR sensor meets these criteria, the sensor can be dropped through a simple plastic guide/ferrous pipe tube. The sensor output is recorded by a high bandwidth oscilloscope and then uploaded to the computer for analysis.

Figure 9:
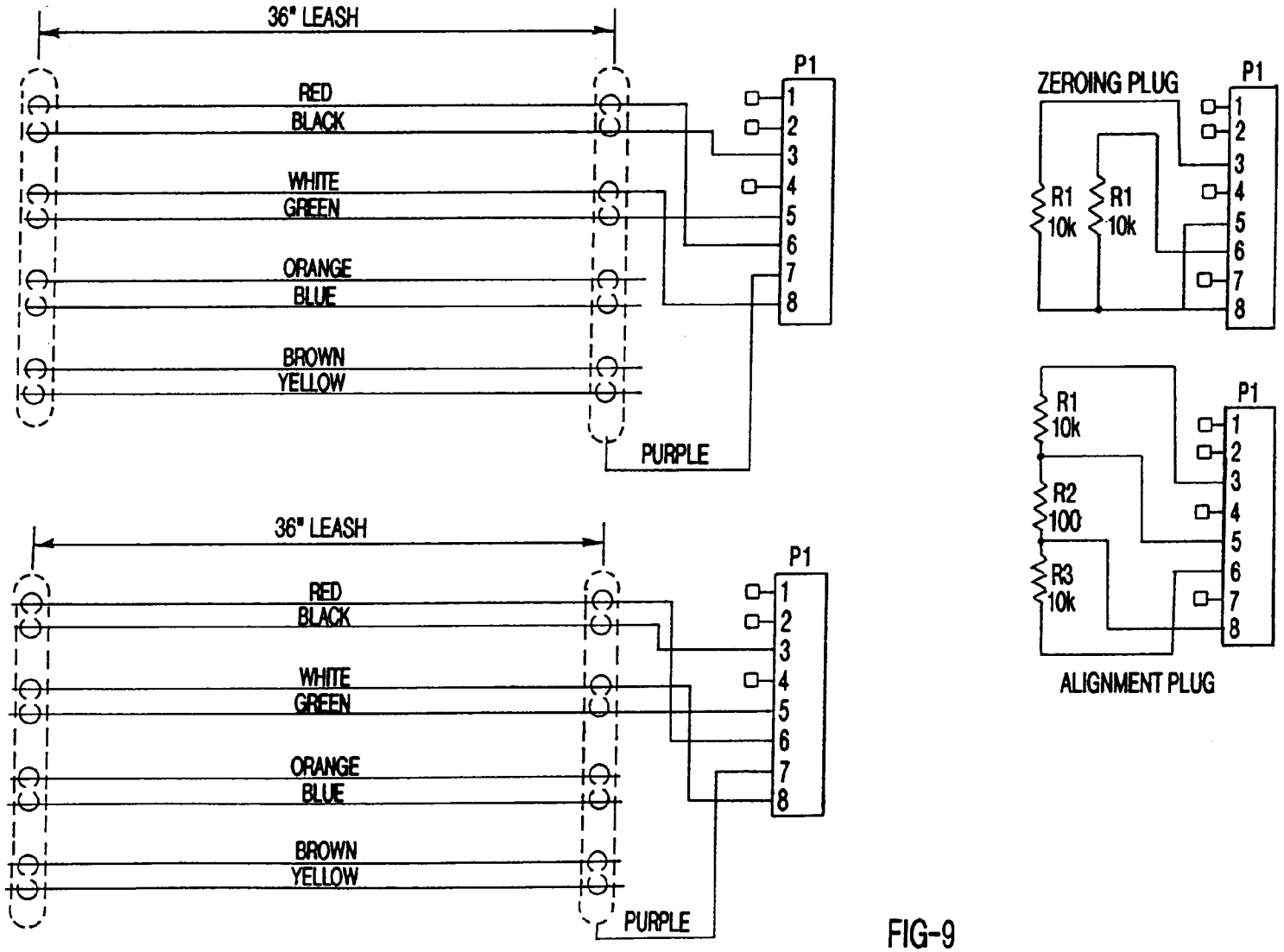
FIG. 9 is a schematic diagram of a magnetic field probe useful in testing the invention.
Figure 10:
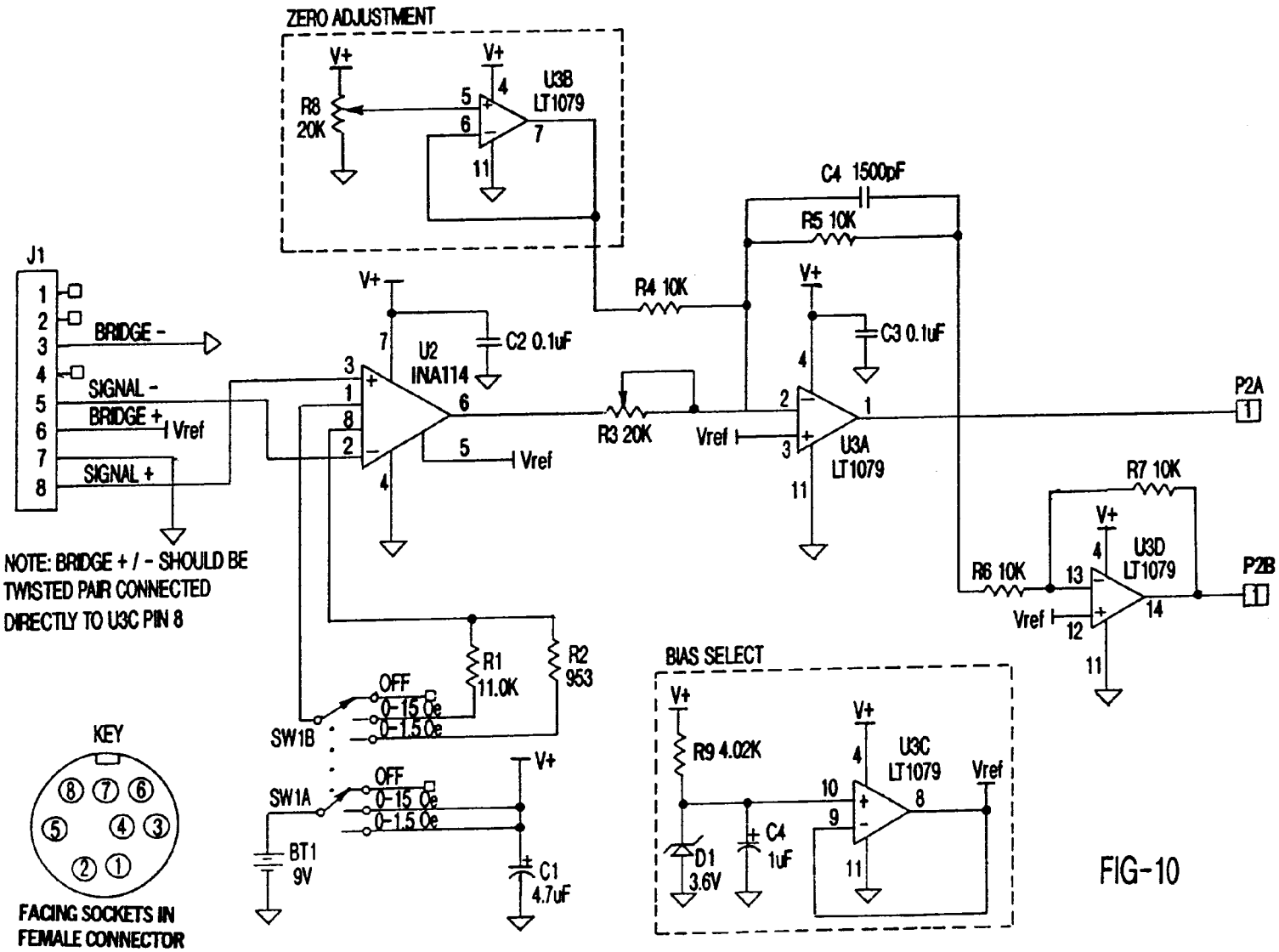
FIG. 10 is a schematic diagram of a gaussmeter probe useful in testing the invention.
Figure 11A:
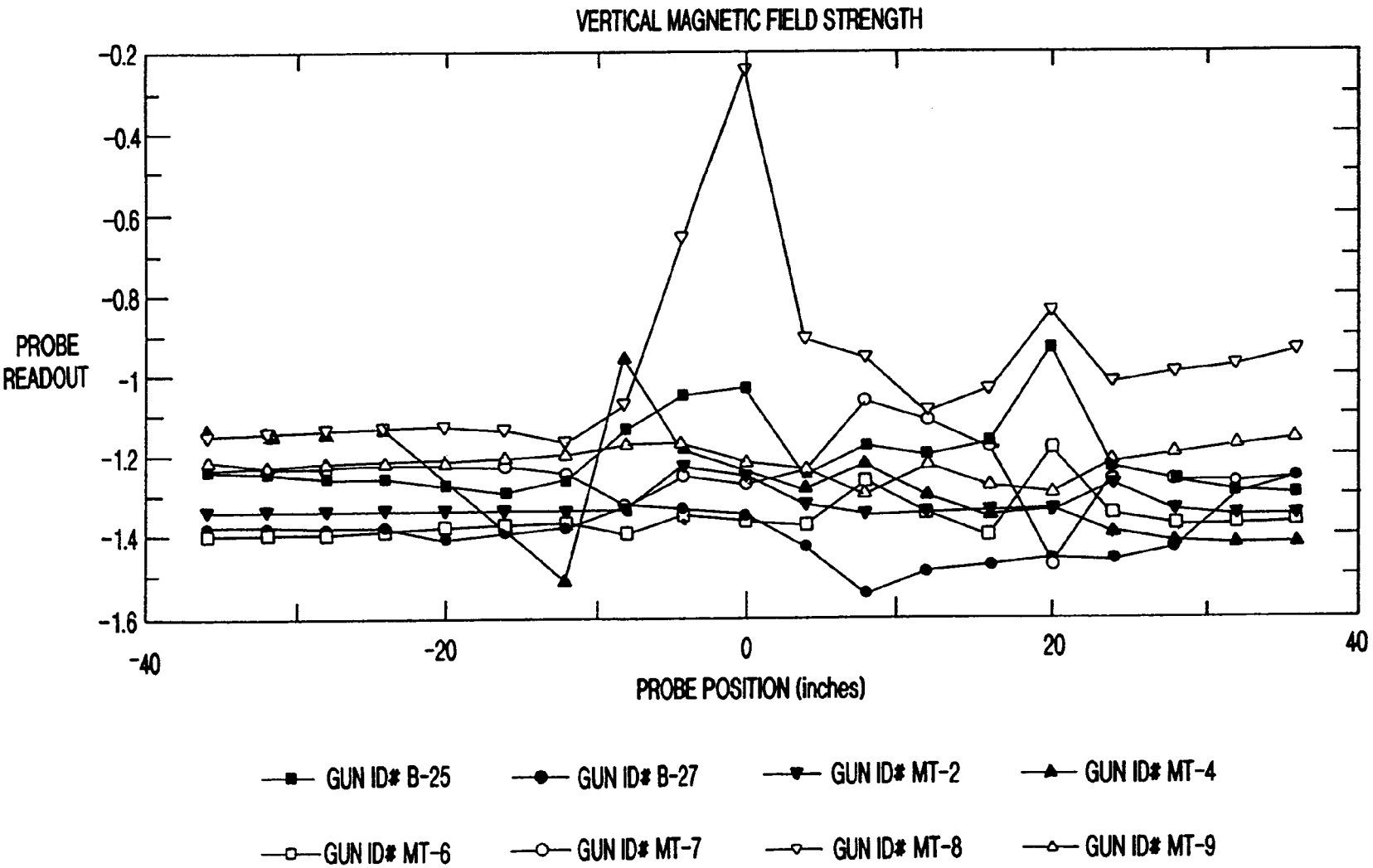
FIGS. 11(*a*)–(*d*) are plots of testing data correlating probe readouts to probe position within a plurality of gun barrels.
Figure 11B:
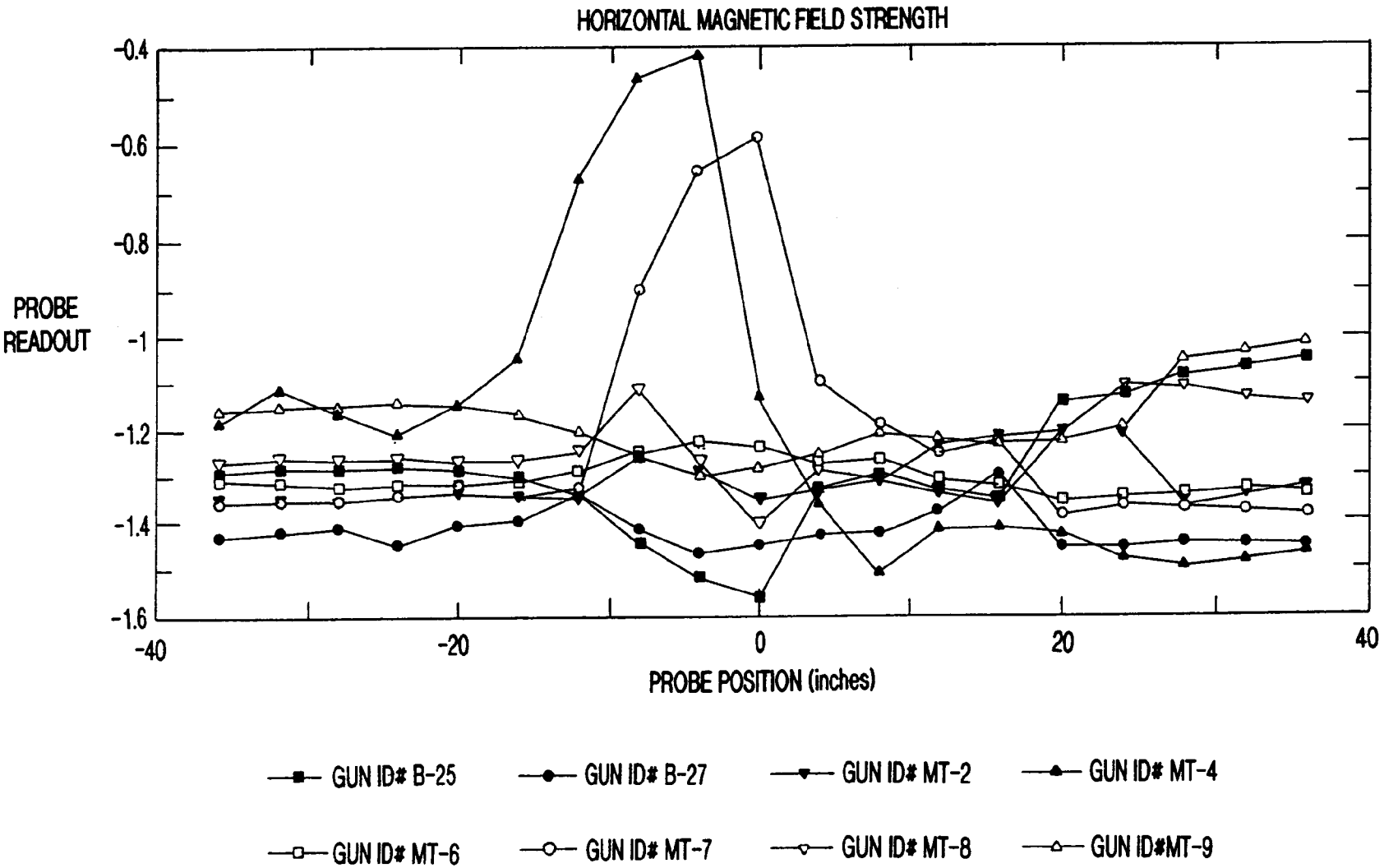
Figure 11C:
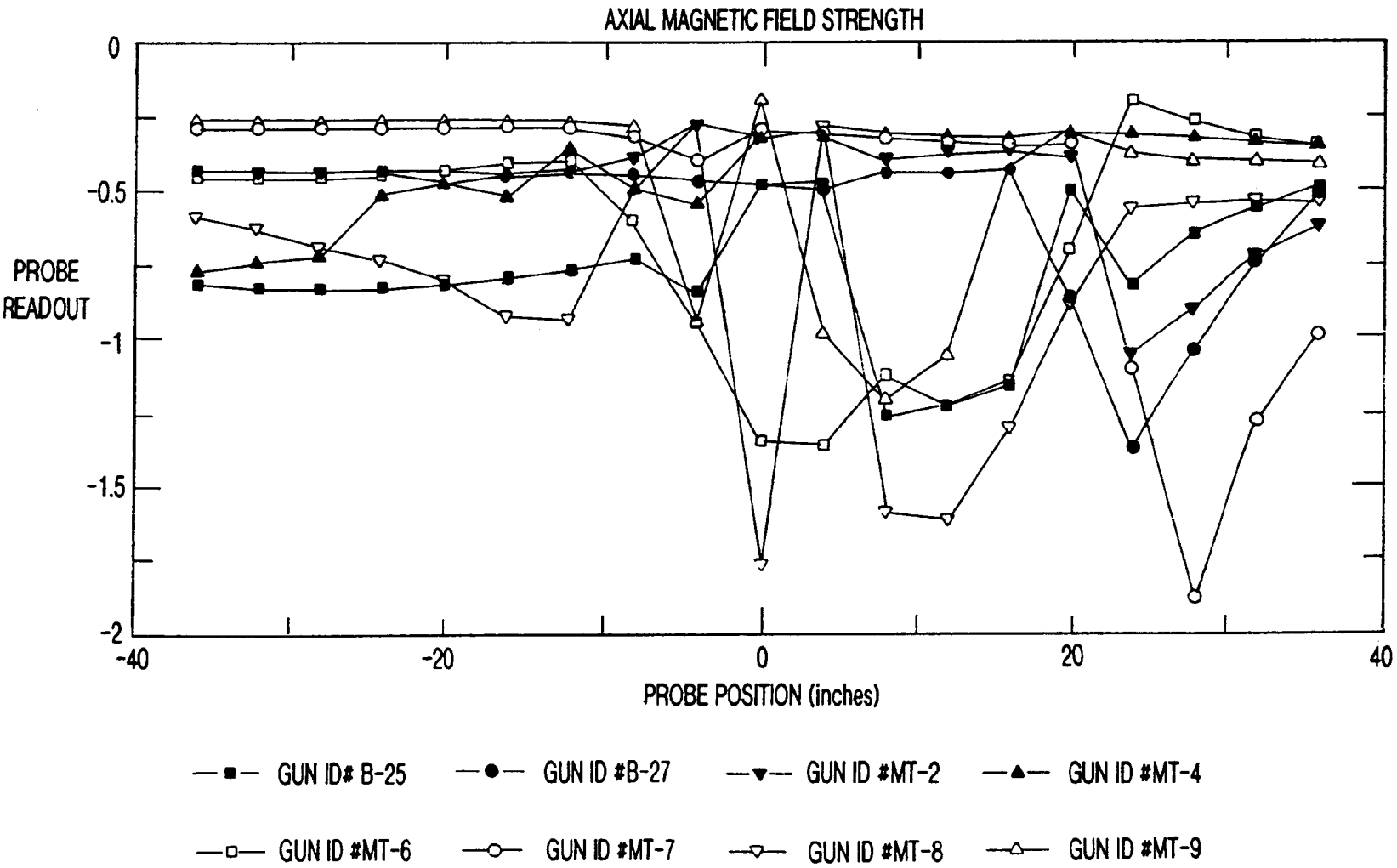
Figure 11D:
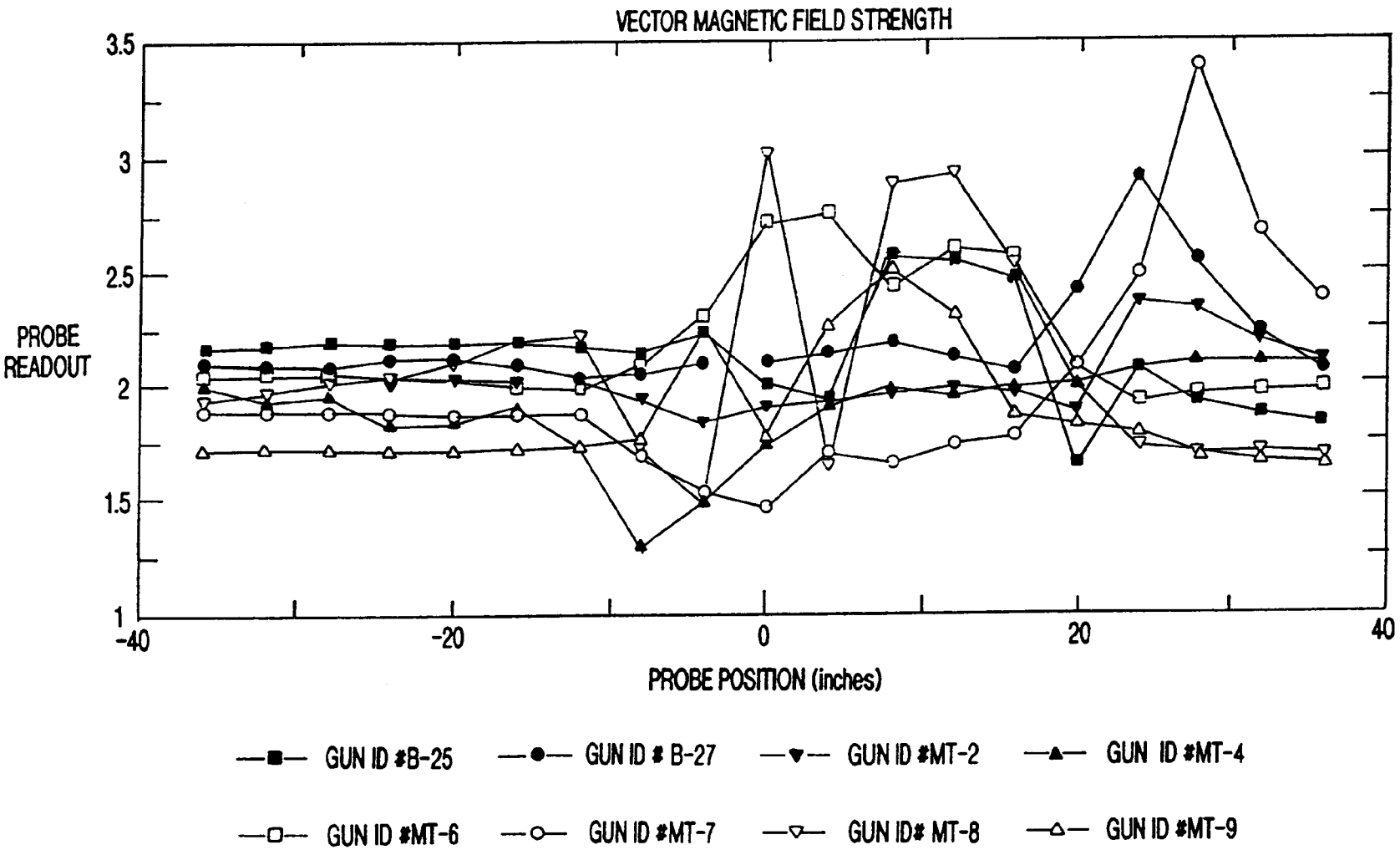

Testing verified the viability of using magnetic field variation to detect barrel exit. FIG. 9 is a circuit diagram of a magnetic filed probe used to perform such testing. FIG. 10 is a circuit diagram of a gaussmeter probe also used to perform the testing. FIGS. 11*a* through 11*d* are graphical plots of the testing data, correlating the probe readouts to probe position within various gun barrels. From the data, it is concluded that the ferrous materials in the gun barrels strongly affect the strength and orientation of the ambient magnetic fields. The data plots of FIGS. 11*a–d* show extreme variation for probe positions >0" (outside the barrel), strong variation for positions >−8" (near the muzzle), and small variation for positions <−8" (well within the barrel). This indicates that sensing barrel exit is detectable based on a field strength threshold.

EXAMPLE 2

Example 1 demonstrated that giant magnetoresistance (GMR)-based sensors are both highly sensitive and compatible with extremely harsh mechanical and thermal environments. These sensors are an ideal technology for fuzing applications owing to their high sensitivity, extreme ruggedness and low production cost. In addition to tank and artillery round applications, the invention is useful for "less-than-lethal" fuzes, orientation sensors for missile guidance systems, and rocket fuzes.

An extensive survey was conducted to determine the impact of gun barrels on the localized earth magnetic field. Eight self-propelled guns were surveyed. The earth's magnetic field was monitored using both GMR-based sensor probes and a commercial gaussmeter from F.W. Bell. Since the GMR probes had vastly superior signal quality compared with the F.W. Bell gaussmeter, the meter was used primarily as a calibrated reference.

Figure 12A:
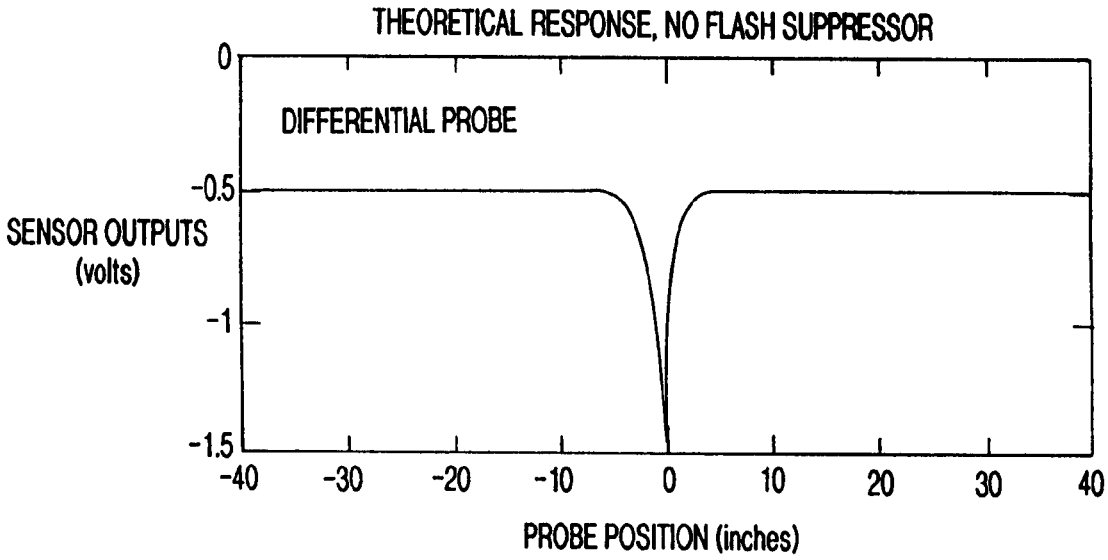
FIGS. 12(*a*) and (*b*) are graphs of theoretical (a) and measured (b) response in a 155 mm gun magnetic field survey.
Figure 12B:
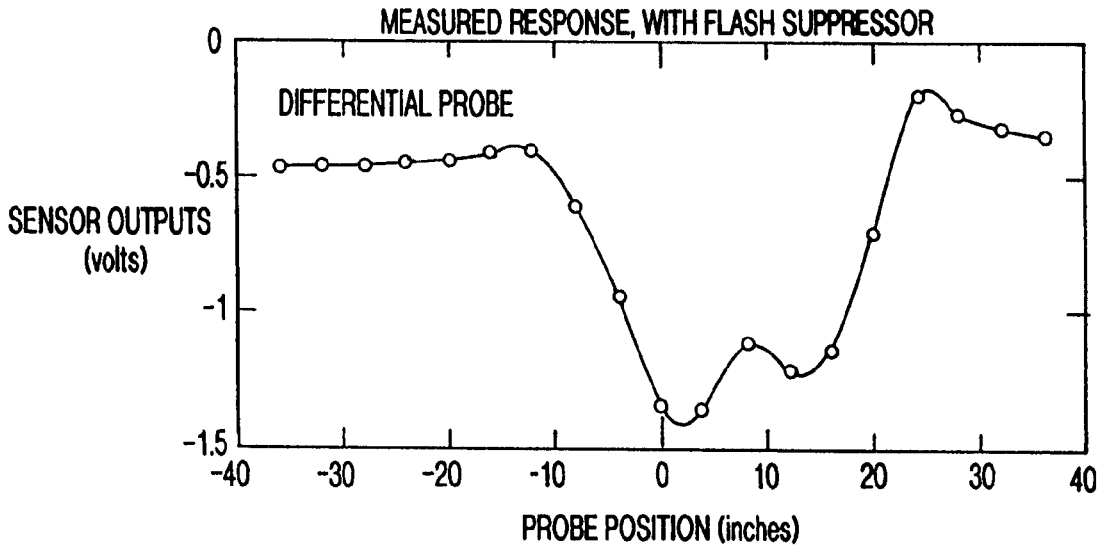

FIG. 12 shows theoretical and measured plots of the magnetic field strength, using a differential GMR sensor, for a 155 mm gun. Field strength within the gun barrel is very low owing to the shielding effects of the barrel. As the probe approaches the end of the barrel, field strength increases rapidly. As the probe passes through the 18" flash suppressor the field response deviates from theory owing to the magnetic signature of the flash suppressor. Finally, as the probe exits the suppressor the field stabilizes at the expected level.

The survey data demonstrated the applicability of the invention to a barrel exit sensor based on a GMR element. Even with the presence of a flash suppressor, the barrel exit is clearly detectable. With the survey data, a preferred specification for the GMR sensor element was developed. This is critical because GMR properties can vary widely.

Figure 13:
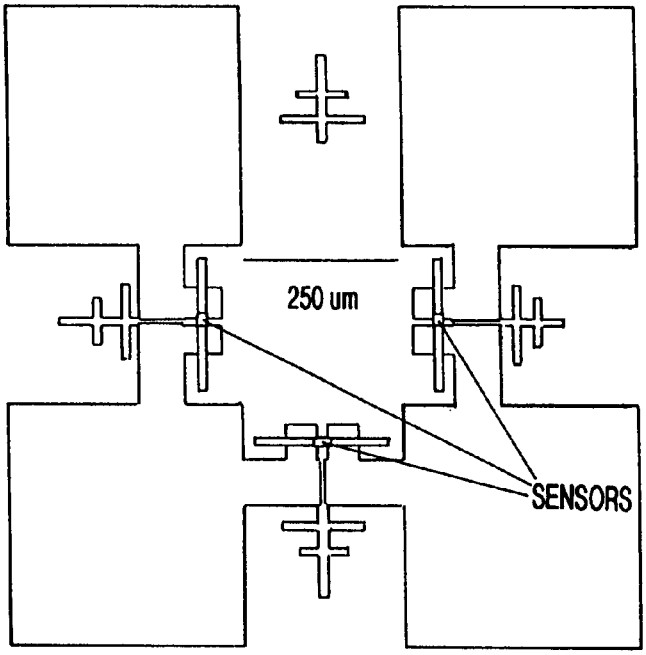
FIG. 13 is a micrograph of a three-sensor, dual-axis GMR sensor of the invention.
Figure 14:
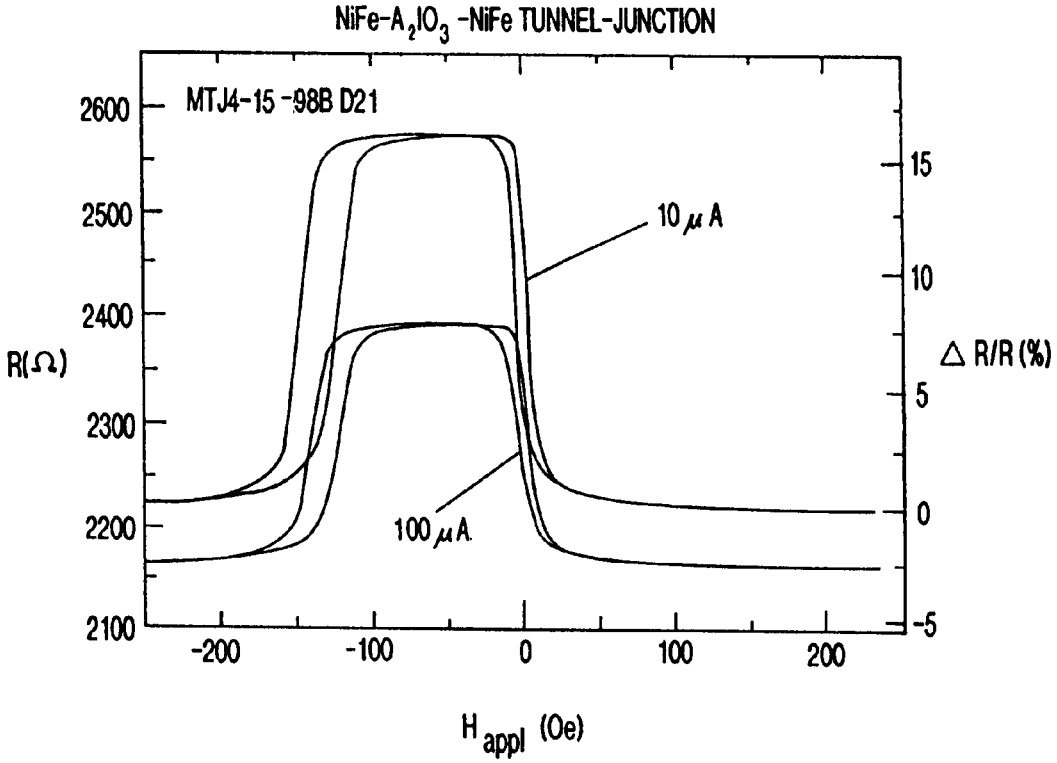
FIG. 14 plots resistance change as a function of applied field for tunnel-junction sensors of the invention, with two bias currents shown.
Figure 34:
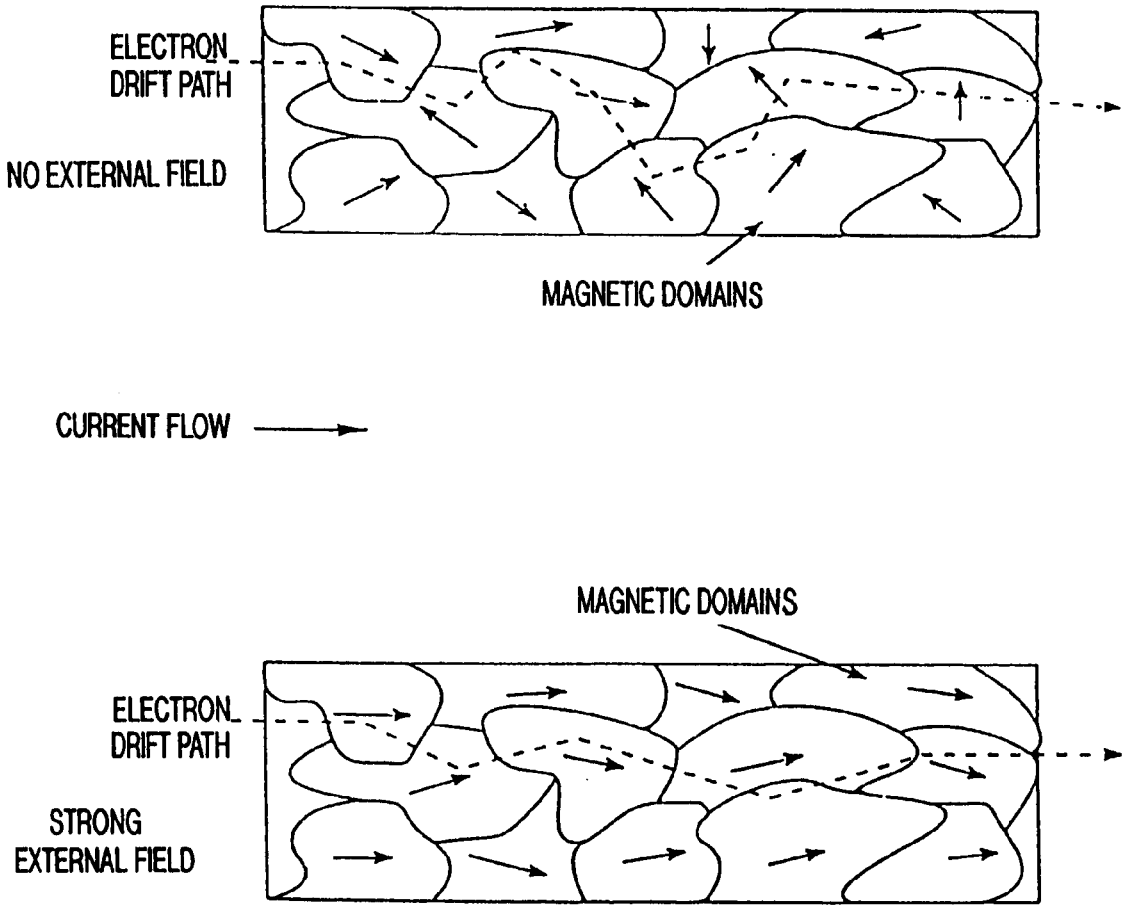
FIG. 34 shows electron drift paths for anisotropic magnetoresistance (AMR) devices with no external field versus a strong external field.
Figure 35:
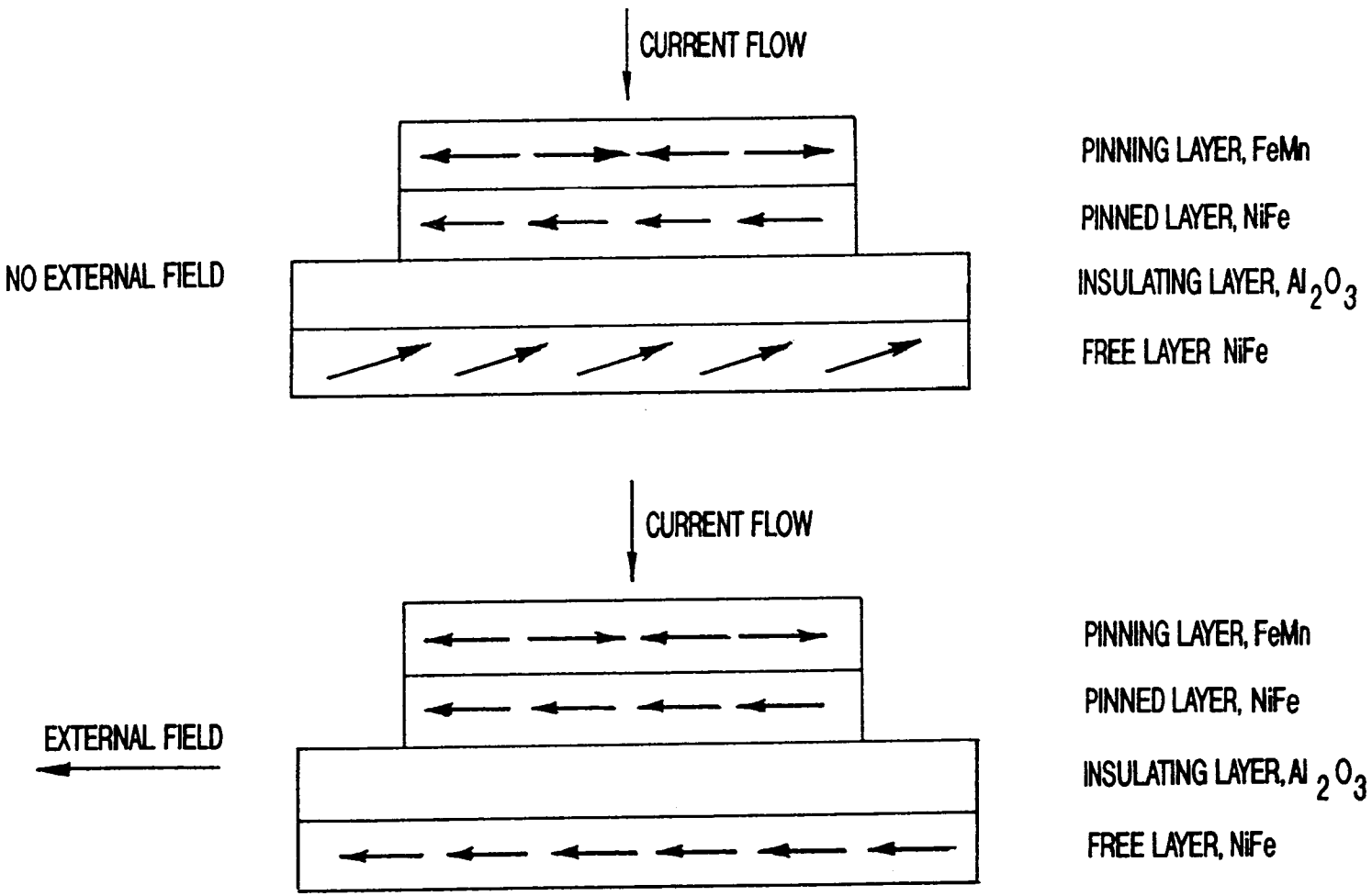
FIG. 35 shows electron drift paths for giant magnetoresistance "tunnel-unctions" devices with no external field versus a strong external field.
Figure 36:
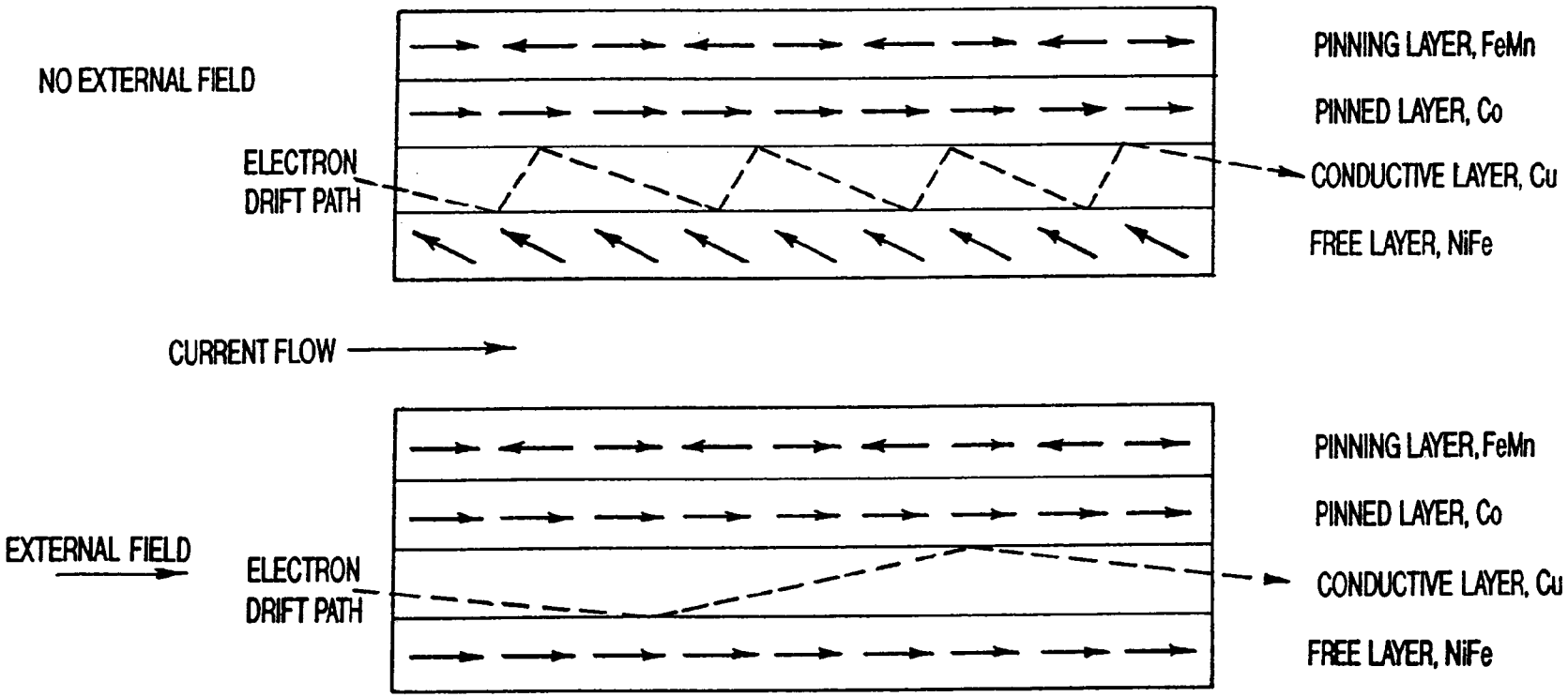
FIG. 36 shows electron drift paths for giant magnetoresistance "spin-valves" devices with no external field versus a strong external field.

Prototype systems using commercially available sensors and customized GMR sensors based on both "spin-valves" and "tunnel junctions" were developed. FIGS. 35 and 36 illustrate electron drift paths for tunnel junction and spin-valves devices, versus those of AMR devices in FIG. 34. The primary advantage of the tunnel-junction is lower power requirements (nearly 40× less power) and a smaller sensor with no performance degradation. Both spin-valves and tunnel-junctions provide a linear range of −12 to +12 Oe. FIG. 13 shows a micrograph of one of the spin-valves, and FIG. 14 shows resistance change as a function of applied field for the tunnel junctions embodiment.

Figure 15:
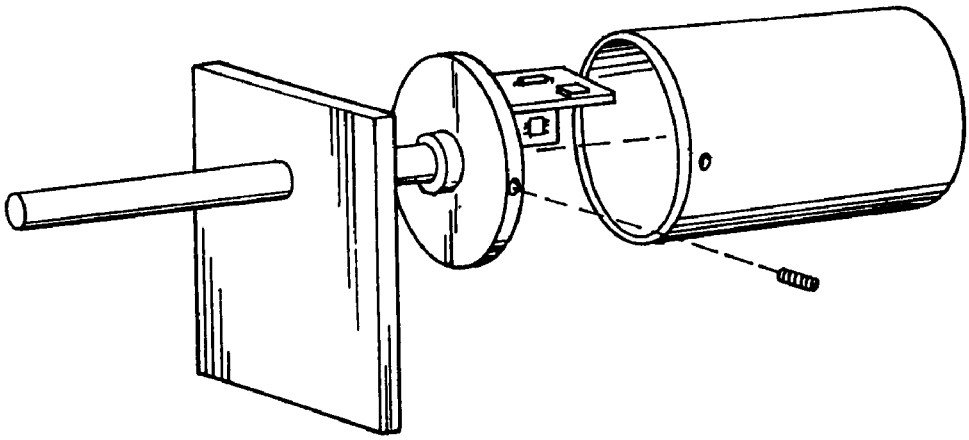
FIG. 15 is a perspective view of a spinning-round embodiment of the invention with the cover removed to show sensors and electronics positioning.
Figure 16:
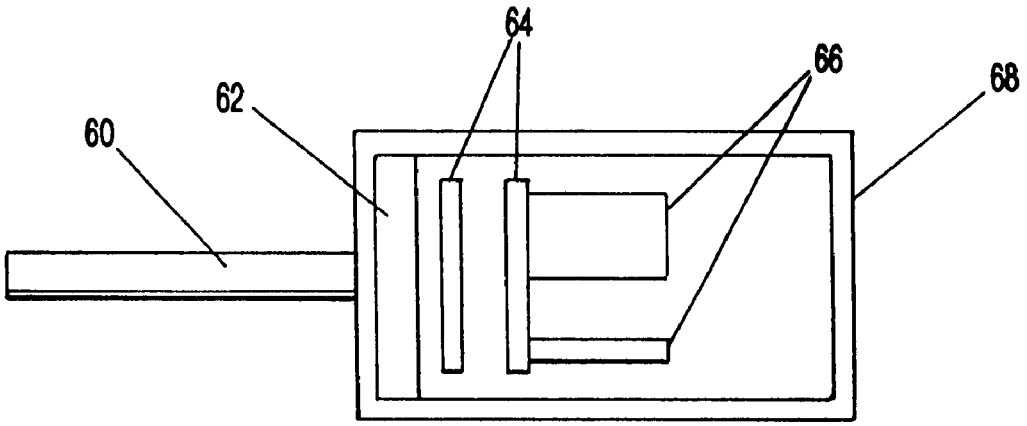
FIG. 16 is a cut-away diagram of the spinning-round embodiment.
Figure 17:
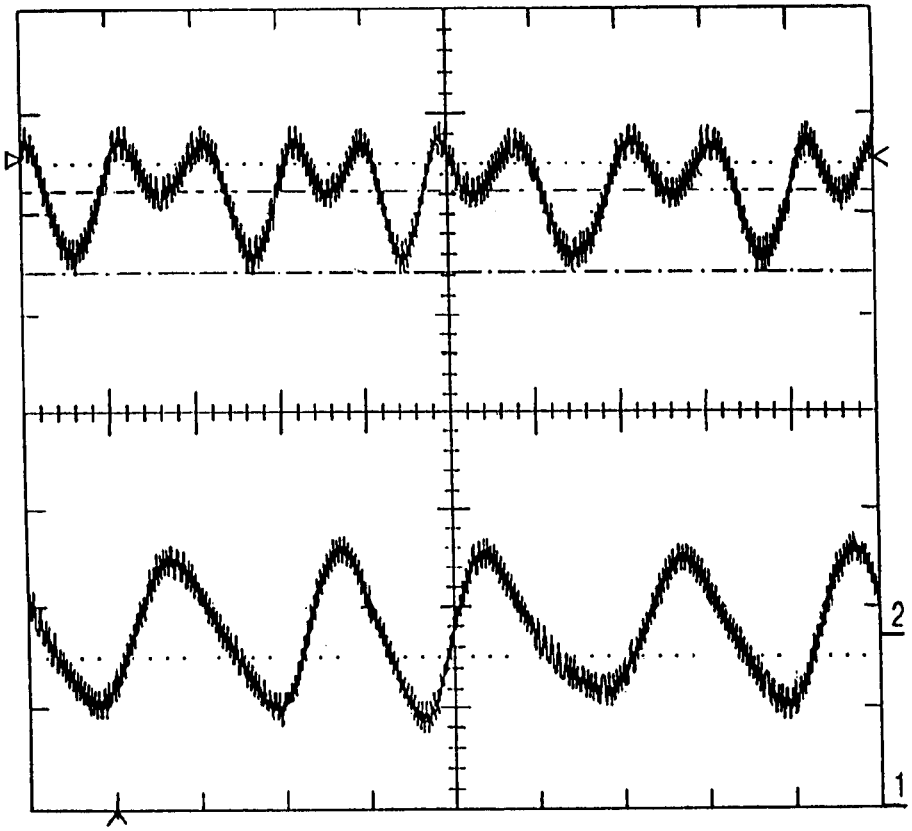
FIG. 17 is a plot of X and Y axis sensor outputs for a turns-counter embodiment of the invention.

A bench-top spinning round prototype sensor was fabricated and tested. The prototype consisted of signal processing electronics and two GMR sensors, oriented with their sensing axes orthogonal to one another. The sensors and electronics were housed in an aluminum case and mounted to an axle that allowed rotation of the assembly. A mercury wetted slip-ring was used to transmit electrical signals from the sensors to an external data acquisition system. Although excessive noise was observed initially in the sensor signal, this was traced to a poorly matched analog-to-digital converter impedance. A photograph and diagram of the spinning round prototype are shown in FIGS. 15 and 16. Subsequent replacement improved the signal substantially as shown in FIG. 17, with sensor rotation shaft 60, base plate 62, signal processing boards 64, sensor boards 66, and protective cover 68.

The utility of a high-accuracy barrel exit sensor is twofold. First, notification of barrel exit provides a second safing parameter, required by MIL-STD-1316D, in addition to set-back. Second, by two different methods, one can use the barrel exit signal to determine the round velocity and, thereby, correct any timing variability such as that caused by wear of rifling surfaces within gun barrels.

Figure 18:
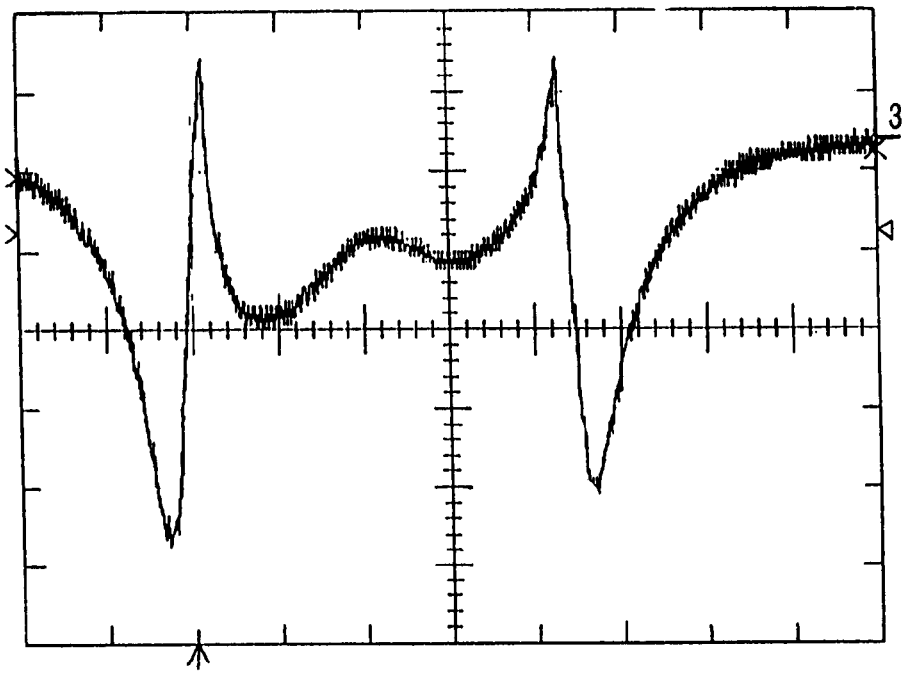
FIG. 18 is a plot of a sensor signal of a barrel-exit embodiment of the invention as it enters and its a section of iron pipe during a drop test.

Maximum barrel exit sensitivity was achieved using a transverse sensor configuration. In such a configuration, the sensitive axis of the device is oriented perpendicular to the magnetic field. When the field is uniform, regardless of field intensity, the sensor outputs a null. If the sensor approaches and crosses some anomaly within the field, however, there is a spatial component of the field that will perturb the sensor resulting in a large signal. In the case of barrel exit, the sensor will transmit a transient spike with a time-width inversely proportional to the exit velocity. FIG. 18 shows the sensor entry and exit signal as it passes through a section of iron pipe.

Four devices were subjected to high force shock testing at the Naval Surface Warfare Center, VHg Machine Facility in Panama City, Fla. Only the basic GMR sensor portion of the sensor of the invention was tested.

Figure 19:
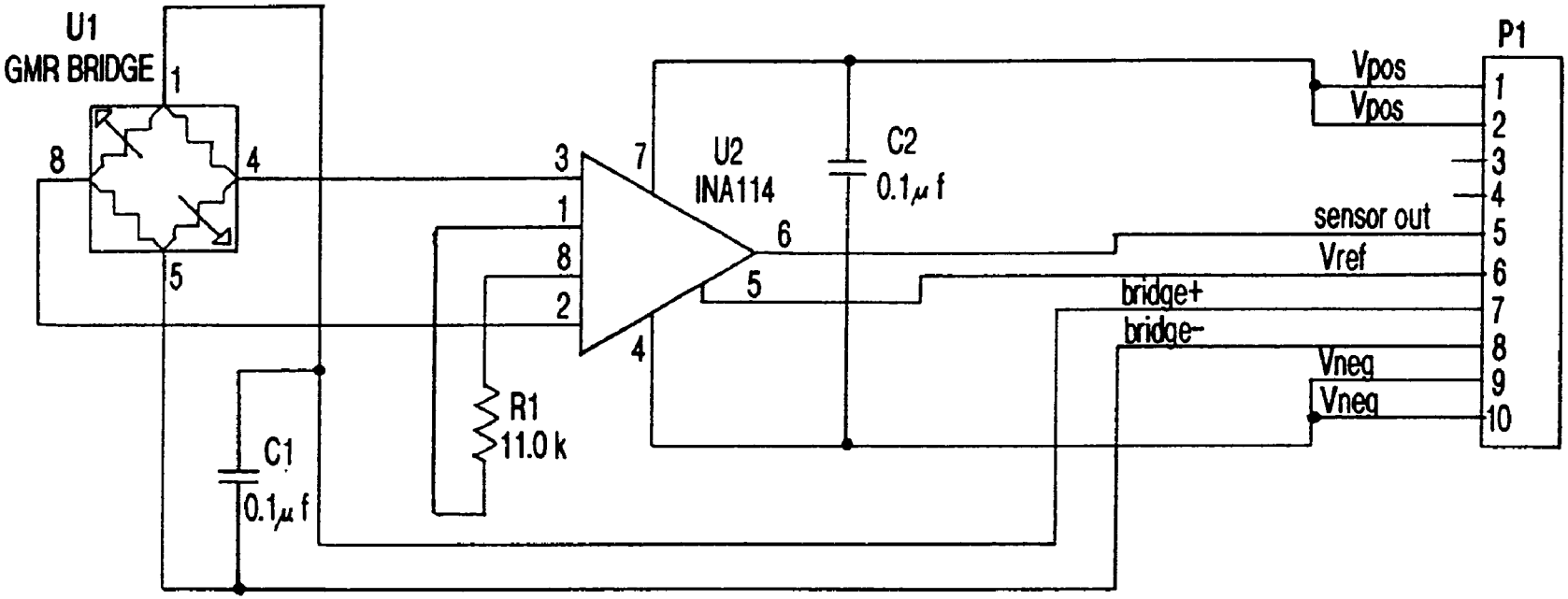
FIG. 19 is a schematic of a dual-sensor GMR bridge circuit of the invention.
Figure 20:
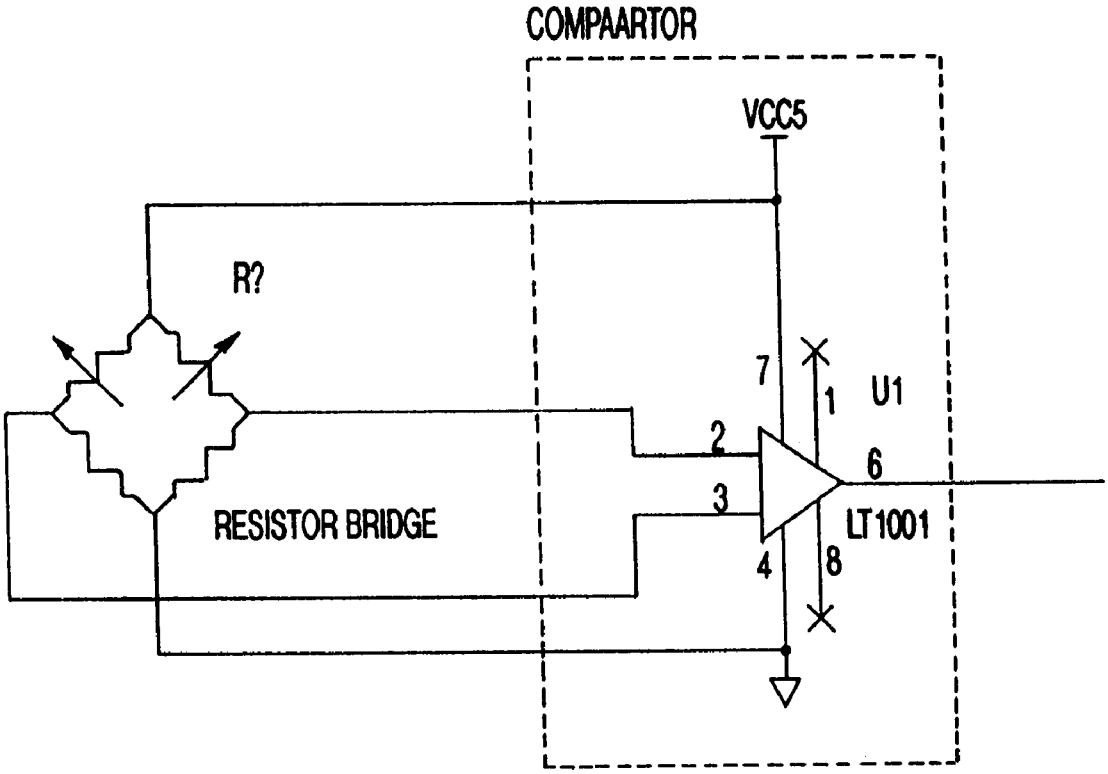
FIG. 20 is a schematic of a simplified single element resistor bridge circuit of the invention.
Figure 21:
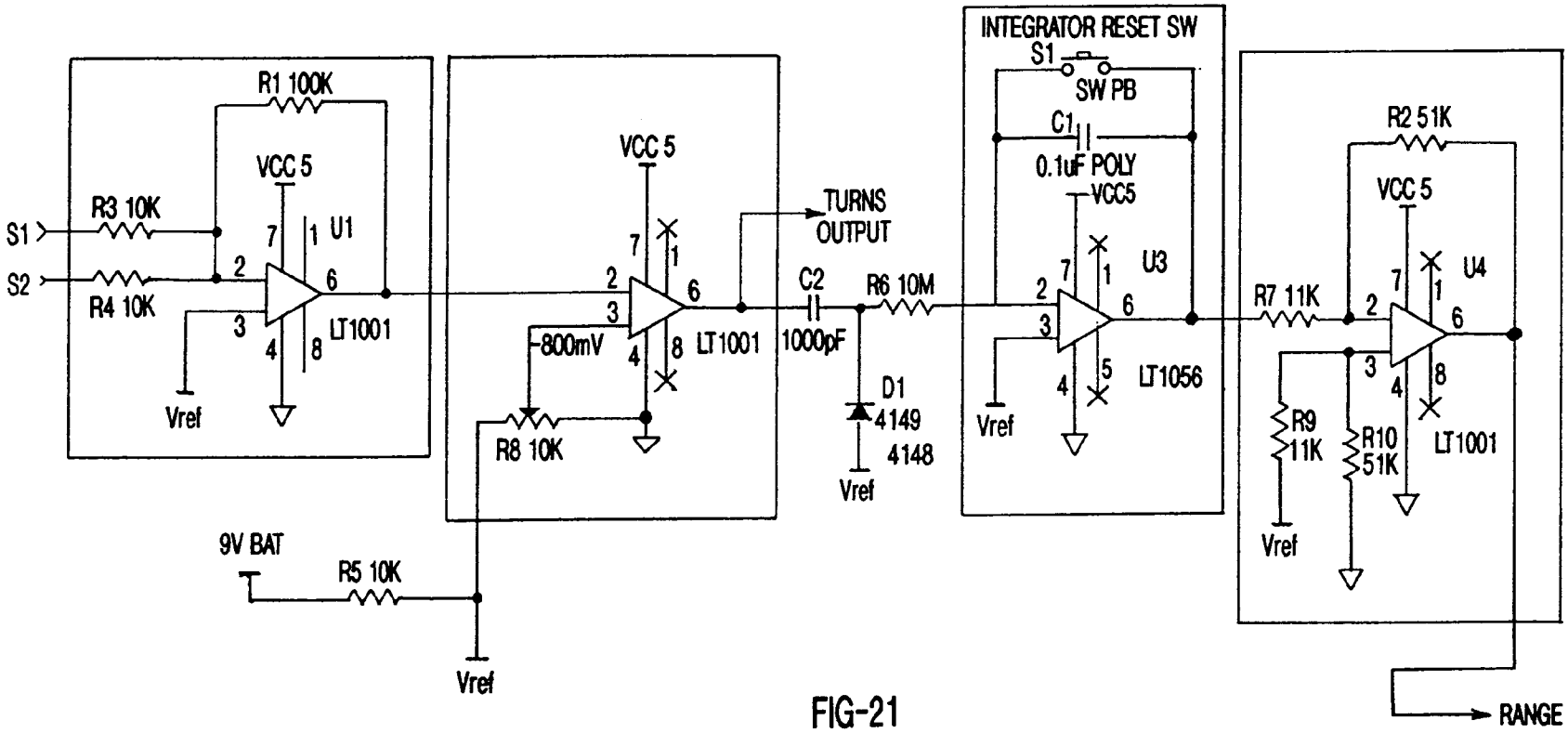
FIG. 21 is a schematic of a signal conditioning circuit of the invention.

FIGS. 19–21 show schematics for circuits used in the Phase I prototypes. The initial GMR bridge circuit (FIG. 19) was replaced with a simpler single sensor resistor bridge (FIG. 20) with no degradation in performance.

Figure 22B:
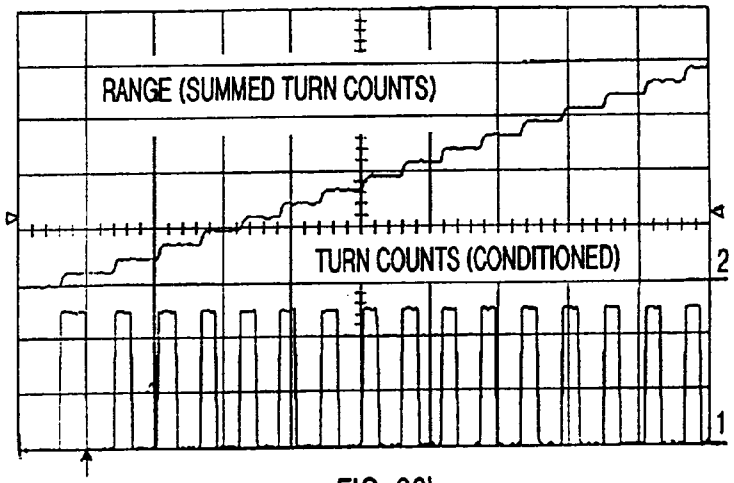
FIGS. 22(*a*) and (*b*) plot raw and conditioned turns-counter signals.
Figure 22A:
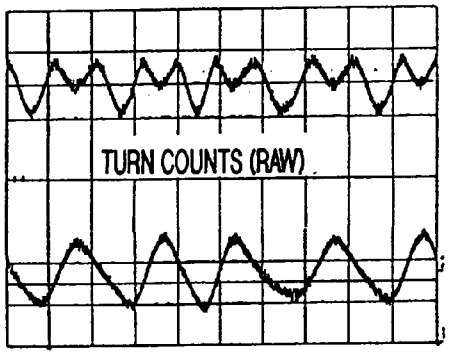
Figure 23:
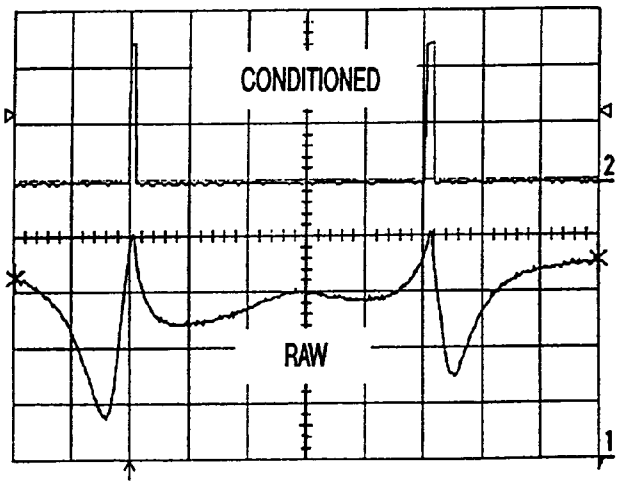
FIG. 23 plots raw and conditioned muzzle-exit signals.

The conditioning electronics allow conversion of the raw data signals to square-wave signals compatible with standard triggering and counting systems. In the case of the turns counter, the invention included an integrator circuit which outputs a voltage proportional to the sum of the counts. Such a circuit may be utilized as an integral range estimator. FIG. 22 shows the raw and processed turns counter signals. For the muzzle-exit sensor, the same conditioning circuit converts the complicated raw data into a simple square-wave trigger pulse as shown in FIG. 23.

Figure 24:
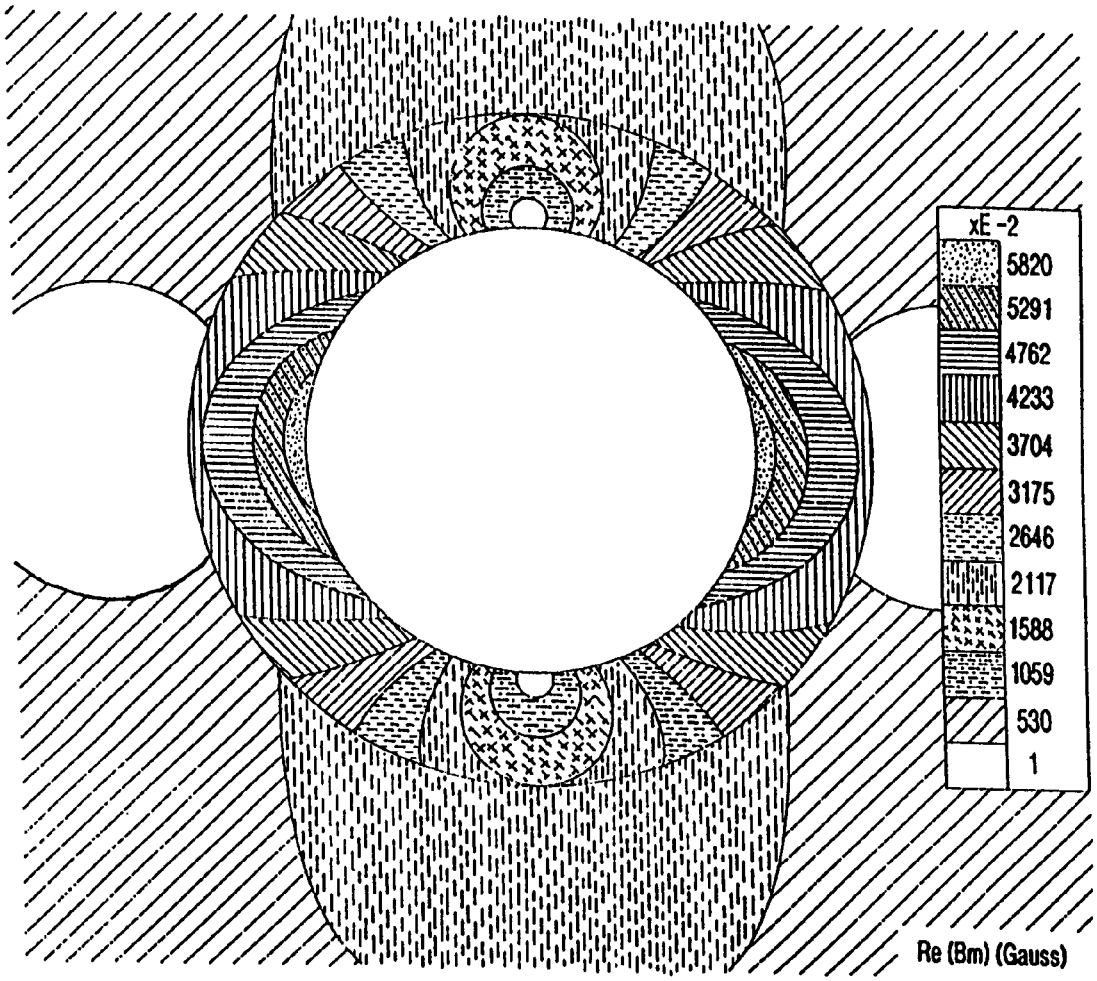
FIG. 24 shows collected earth field lines in barrel material.
Figure 25:
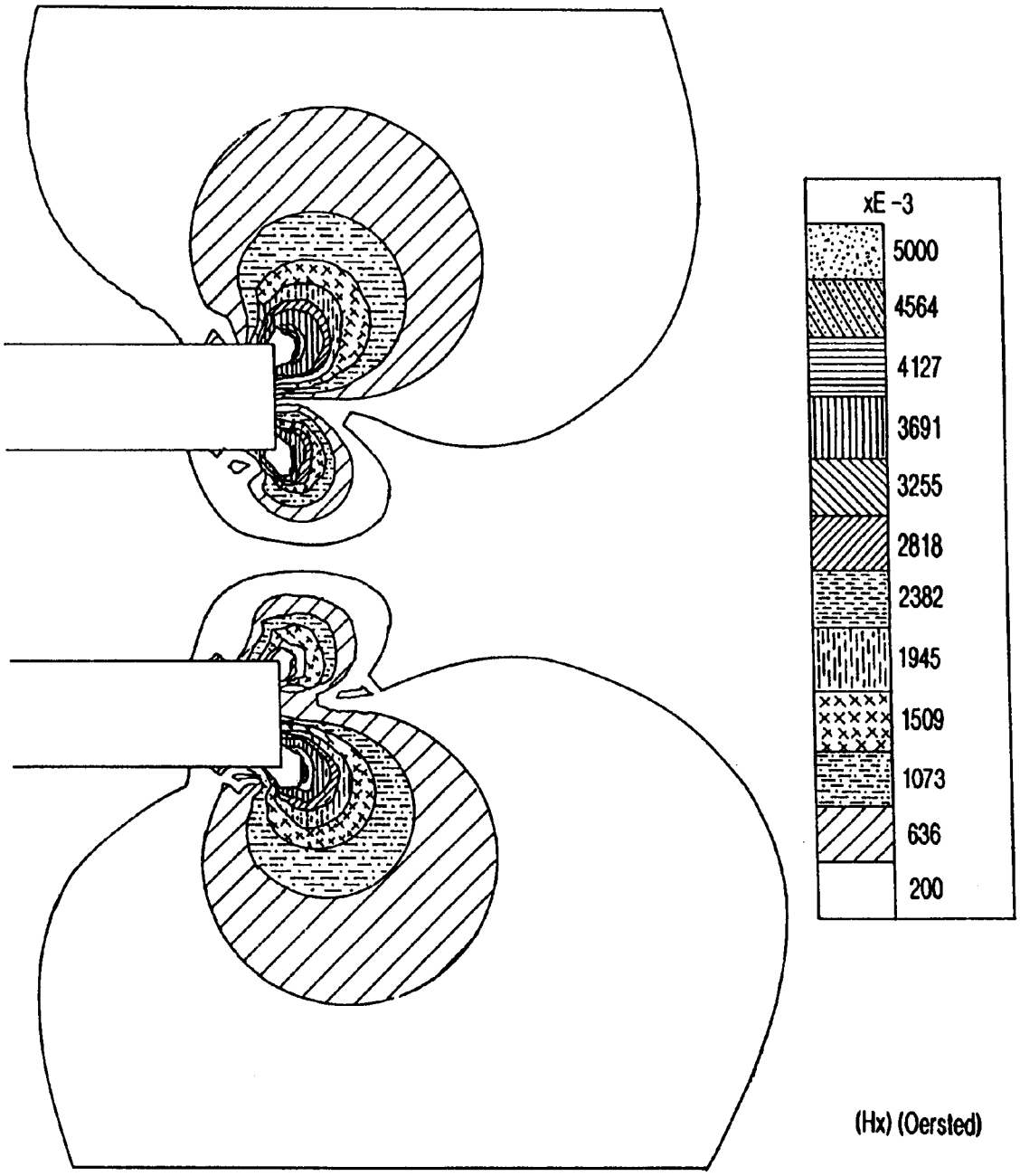
FIG. 25 shows change in shielding (horizontal component) at the muzzle exit resulting in a sharp field discontinuity.
Figure 26:
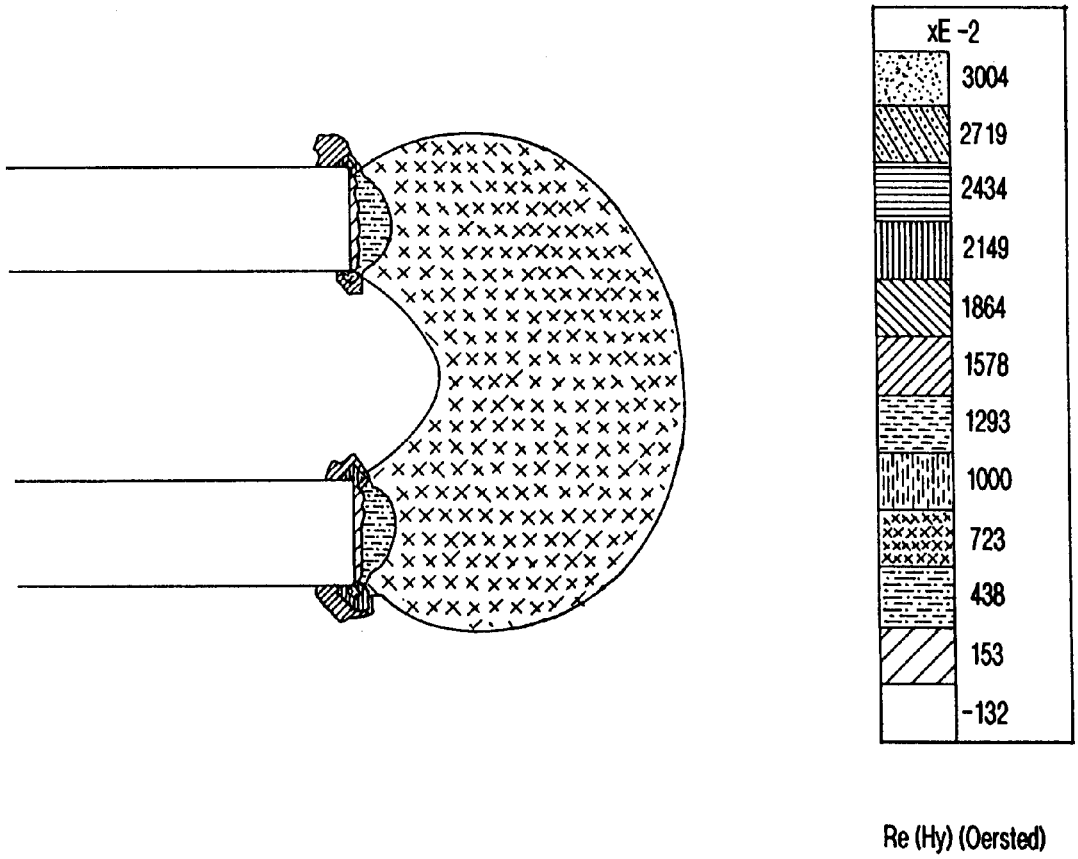
FIG. 26 shows the change in the vertical component of the field, less well-defined that the horizontal component of FIG. 25.
Figure 27:
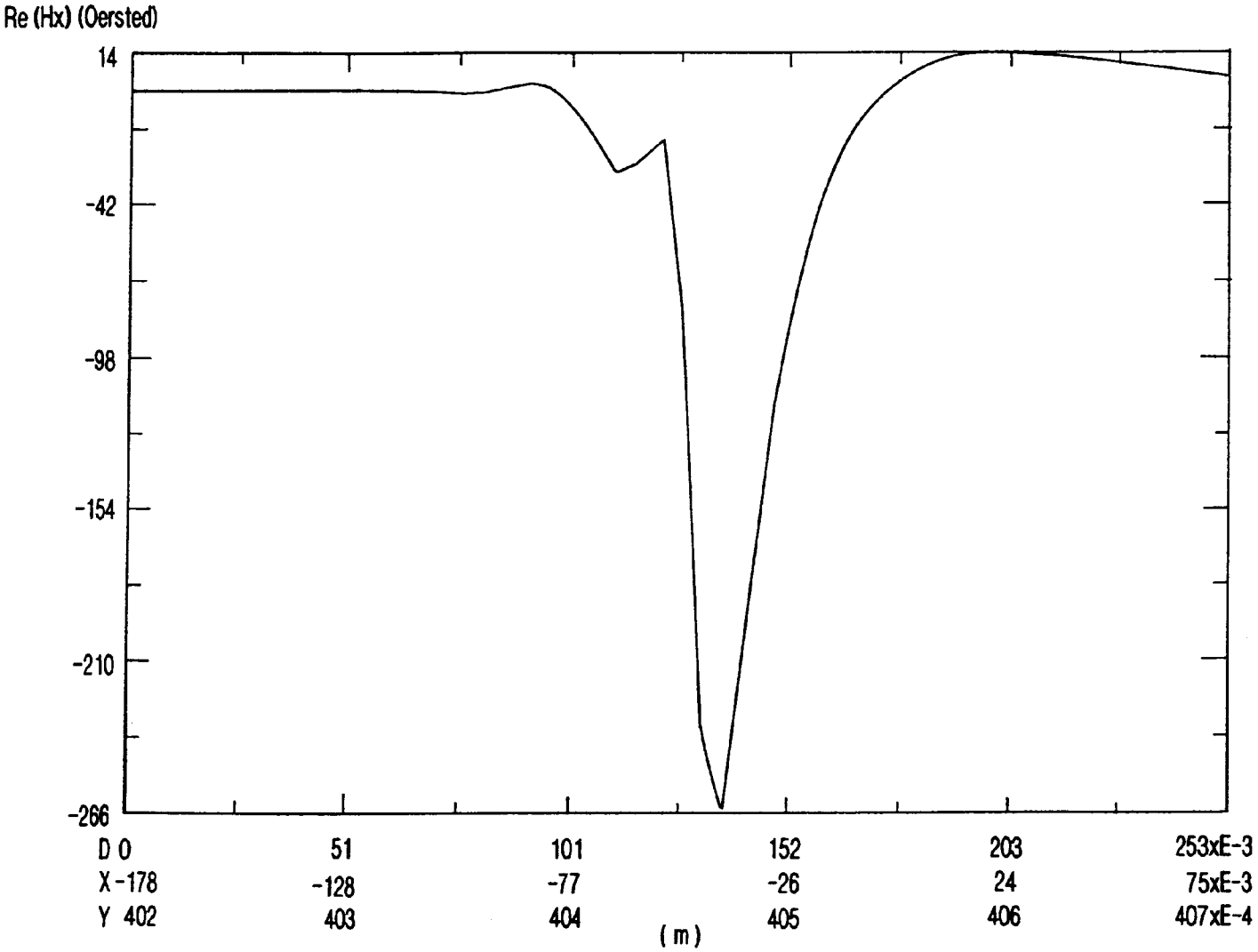
FIG. 27 plots differential sensor predicted response at muzzle exit, precise timing being facilitated by the sharpness of the differentially oriented sensor.

Boundary element modeling was used to evaluate the barrel exit application. FIGS. 24 through 27 show results of the modeling effort. FIG. 24 shows a view of the magnetic field looking down the barrel axis. The barrel collects the field lines in effect shielding the barrel interior from the earth's magnetic field. At the muzzle exit (FIGS. 26–27) the loss of shielding results in a strong discontinuity in the earth's field. FIG. 25 shows the horizontal (i.e., differential) component of the field along the barrel axis. The field discontinuity results in a very sharp peak at the muzzle exit. In addition to supplying an easily sensed safing signal, this allows a precise time to be assigned to the muzzle exit so that velocity corrections might be available to the fuze if needed.

Figure 28:
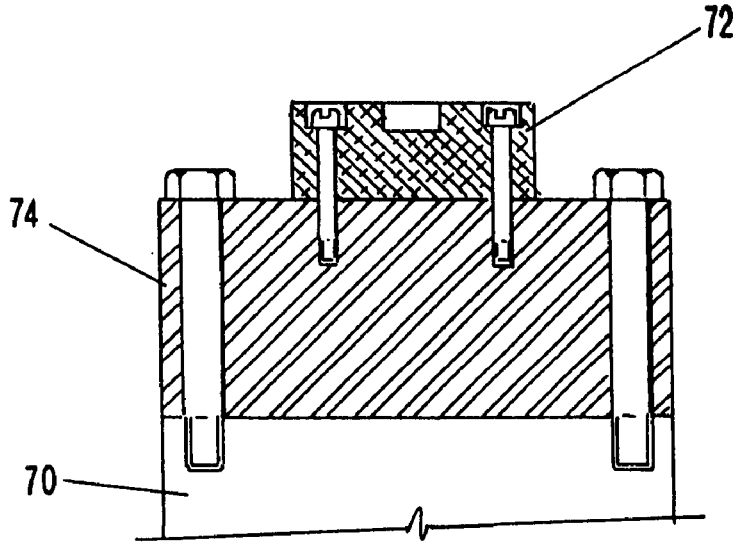
FIG. 28 is a cut-away view of a mechanical assembly used to hold sensors and accelerometer during shock testing.
Figure 29:
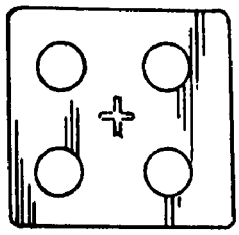
FIG. 29 is a magnified view of the 1 mm ×1 mm sensor of the invention.

FIG. 28 shows the mechanical configuration of the tested sensors, with balast flange 70, device flange 72, and existing test carriage 74. Each sensor, approximately 1 mm ×1 mm ×0.25 mm, was mounted to a small piece of prototyping board and wire bonded to solid electrodes. This assembly, shown in FIG. 29, was then polted in epoxy within the orifice in the VHg test piece.

Figure 30:
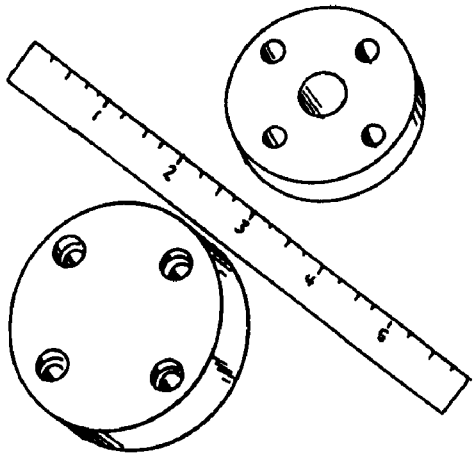
FIG. 30 shows top and bottom of shock test pieces.

The completed test pieces (FIG. 30) were evaluated using the magnetic test apparatus of Example 1 to establish a baseline performance within the mechanical test piece. The test pieces were then tested using an accelerometer mounted into the test piece for all shock tests, the actual forces experienced by the test piece being recorded.

Figure 31:
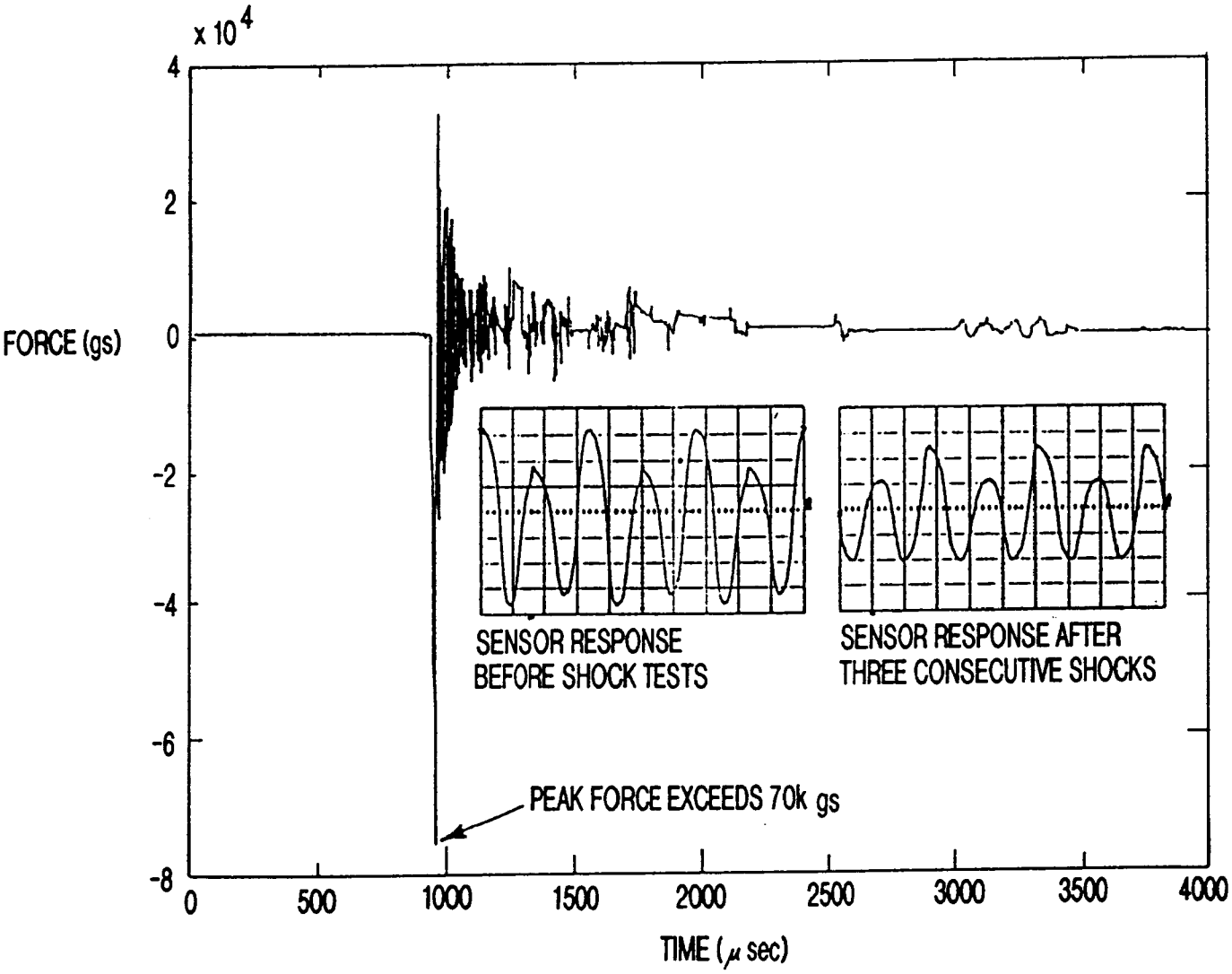
FIG. 31 plots accelerometer data and before and after signal traces for a sensor of the invention that was severely shocked three times.

None of the test pieces suffered any degradation in performance as a result of shock test. FIG. 31 shows the recorded accelerometer data for one of the three shocks experienced by the most severely tested piece. FIG. 31 also shows the sensor response before and after shock testing. The output amplitude difference is caused by the inaccuracy in aligning the sensor with the test apparatus. There is no decrease in the signal-tonoise ratio; that is the baseline sensor output quality has not been degraded.

Figure 32:
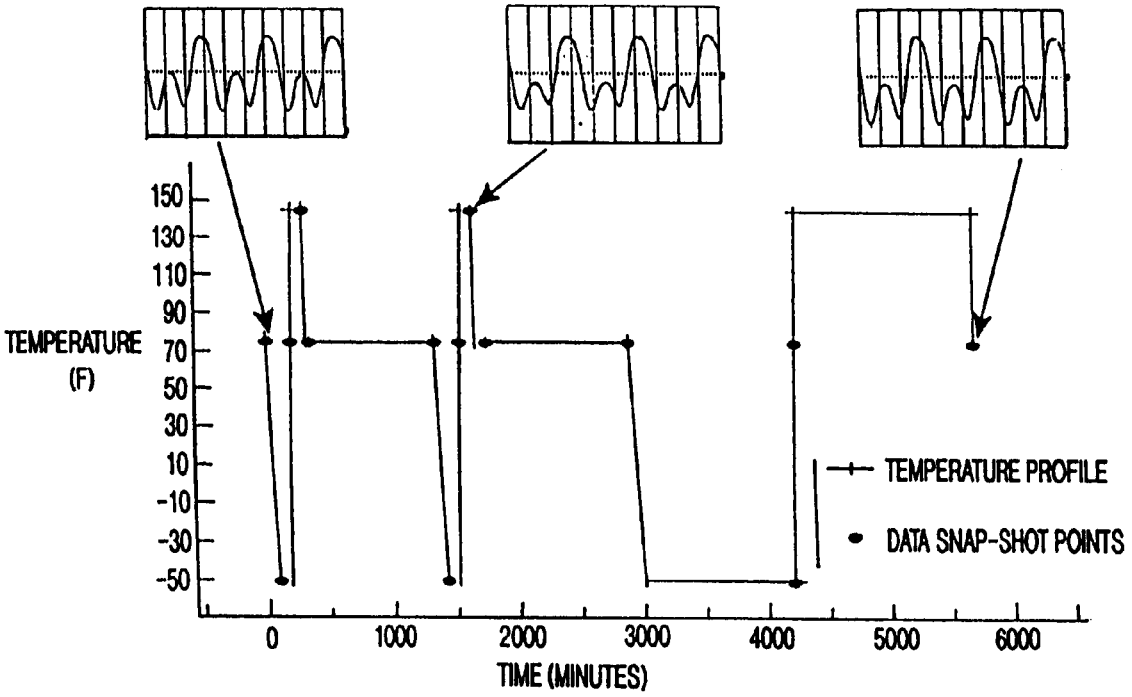
FIG. 32 plots thermal profile with overlaid plots of sensor output during testing.

One of the prototype sensors was configured with an excitation coil to simulate the alternating magnetic field signature experienced by a spin-stabilized round. The prototype was then temperature cycled. The sensor was run continuously during environmental testing. FIG. 32 shows the temperature profile for the environmental test. Data "snap-shots", consisting of a waveform download from the data acquisition system, were performed at time points corresponding to the round points in the temperature profile plot. Actual snap shots are overlaid for the indicated points.

The sensor suffered no performance degradation. The only notable changes in the sensor output were lower noise at low temperatures and slightly higher noise at higher temperatures. This type of change is entirely expected in any electronics circuit and should have no affect on sensor performance.

Figure 33:
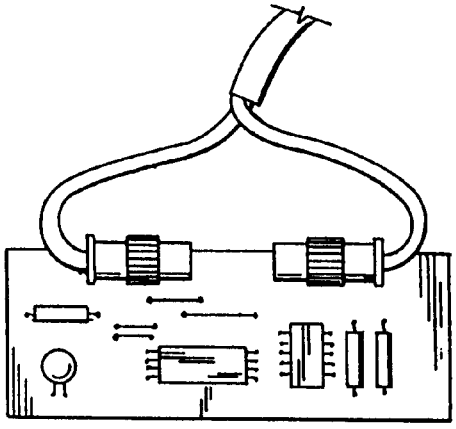
FIG. 33 is a perspective view of the sensor assembly immediately after retrieval from a liquid nitrogen bath, with traces shown before, during, and after the soak at −196° C. (77 Kelvin)

Finally, in order to demonstrate the temperature stability at an extreme, the active prototype was rapidly immersed in a bath of liquid nitrogen (−180° C.). FIG. 33 shows a photograph of the environmental test fixture, including excitation coils, immediately after retrieval from the liquid nitrogen bath. Overlays of the before, during and after sensor output is included. Again, no degradation in the sensor occurred. In fact, cooling enhanced the sensor performance.

The preceding examples can be repeated with similar success by substituting the generically or specifically described reactants and/or operating conditions of this invention for those used in the preceding examples.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An apparatus for electronically controlling ordnance fuzes, said apparatus comprising a magnetic field sensor sensing phase and magnitude of earth's local ambient magnetic field, said magnetic field sensor comprising a giant magnetoresistance detector.

2. The apparatus of claim 1 wherein said apparatus additionally comprises means for calculating in-flight cumulative range of spinning ordnance.

3. The apparatus of claim 2 wherein said calculating means comprises means for counting turns of the spinning ordnance.

4. The apparatus of claim 1 wherein said apparatus additionally comprises means for arming ordnance a pre-determined time after exit of the ordnance from a weapon firing the ordnance.

5. The apparatus of claim 4 wherein said arming means comprises means for determining via said magnetic field sensor exit of the ordnance from the weapon firing the ordnance.

6. A method for electronically controlling ordnance fuzes, the method comprising sensing phase and magnitude of earth's local ambient magnetic field proximate the ordnance via a magnetic field sensor, the magnetic field sensor comprising a giant magnetoresistance detector.

7. The method of claim 6 additionally comprising the step of calculating in-flight cumulative range of spinning ordnance.

8. The method of claim 7 wherein the calculating step comprises counting turns of the spinning ordnance.

9. The method of claim 6 additionally comprising the step of arming ordnance a pre-determined time after exit of the ordnance from a weapon firing the ordnance.

10. The method of claim 9 wherein the arming step comprises determining via the magnetic field sensor exit of the ordnance from the weapon firing the ordnance.

11. An angular velocity sensor for spinning ordnance, said sensor comprising:

a turns counter comprising a magnetic field sensor, said magnetic field sensor comprising a giant magnetoresistance detector; and means for computing a time derivative of an inverse sine of an output of said turns counter.

12. A method of sensing angular velocity for spinning ordnance, the method comprising the steps of:

counting turns of the ordnance via a magnetic field sensor, the magnetic field sensor comprising a giant magnetoresistance detector; and computing a time derivative of an inverse sine of an output of the counting step.

* * * * *